US010940970B2

(12) United States Patent
Morizane

(10) Patent No.: US 10,940,970 B2
(45) Date of Patent: Mar. 9, 2021

(54) PACKAGING KIT AND PACKAGING SET

(71) Applicant: TAIYO SHIGYO CO., LTD., Hyogo (JP)

(72) Inventor: Akihiro Morizane, Amagasaki (JP)

(73) Assignee: TAIYO SHIGYO CO., LTD., Hyogo (JP)

( * ) Notice: Subject to any disclaimer, the term of this patent is extended or adjusted under 35 U.S.C. 154(b) by 0 days.

(21) Appl. No.: 16/560,193

(22) Filed: Sep. 4, 2019

(65) Prior Publication Data

US 2020/0071018 A1 Mar. 5, 2020

(30) Foreign Application Priority Data

Sep. 5, 2018 (JP) ..... JP2018-165998

(51) Int. Cl.
*B65D 5/00* (2006.01)
*B65D 21/02* (2006.01)
*B65D 75/14* (2006.01)

(52) U.S. Cl.
CPC ..... *B65D 5/0015* (2013.01); *B65D 21/0212* (2013.01); *B65D 75/14* (2013.01)

(58) Field of Classification Search
CPC ..... B65D 5/15; B65D 75/14; B65D 21/0212; B65D 2571/0066; B65D 71/16; B65D 2571/00308; B65D 77/02
USPC ..... 229/117.03, 104, 105, 122.31, 122.33, 229/165, 169, 183, 103.2; 206/427, 434, 206/140, 784, 429, 156, 194, 197; 220/23.83
See application file for complete search history.

(56) References Cited

U.S. PATENT DOCUMENTS 3,397,776 A * 8/1968 Weiss ..... B65D 71/16 206/431
5,597,071 A * 1/1997 Sutherland ..... B65D 71/16 206/434
5,765,685 A * 6/1998 Roosa ..... B65D 71/16 206/140
6,550,616 B2 * 4/2003 Le Bras ..... B65D 71/16 206/427
7,762,397 B2 * 7/2010 Coltri-Johnson ..... B65D 71/30 206/427
8,272,559 B2 * 9/2012 Sutherland ..... B65D 77/0413 206/784
8,376,213 B2 * 2/2013 Brand ..... B65D 71/16 206/140
2012/0267426 A1 * 10/2012 Hendricks ..... B65D 71/16 229/185

FOREIGN PATENT DOCUMENTS

JP 2015-157637 A 9/2015

* cited by examiner

*Primary Examiner* — Christopher R Demeree
(74) *Attorney, Agent, or Firm* — Studebaker & Brackett PC

(57) ABSTRACT

A packaging kit is composed of a sheet member. A target object to be packaged is to be placed on the sheet member. The sheet member includes a placement surface, a standing side, and a tongue piece. The placement surface allows the target object to be placed thereon. The standing side is elongated from the placement surface. The standing side is raised relative to the placement surface. The tongue piece includes a protrusion edge. The placement surface and the standing side are provided with the tongue piece. The tongue piece is located on a side of at least one side edge of the standing side.

16 Claims, 35 Drawing Sheets

PACKAGING KIT AND PACKAGING SET

INCORPORATION BY REFERENCE

The present application claims priority under 35 U.S.C. § 119 to Japanese Patent Application No. 2018-165998, filed on Sep. 5, 2018. The contents of this application are incorporated herein by reference in their entirety.

BACKGROUND

The present disclosure relates to a packaging kit and a packaging set.

A packaging box is provided with fold lines. The packaging box is set up by bending some parts of a sheet of cardboard along the fold lines, thereby enabling packaging of a target object to be packaged.

SUMMARY

A packaging kit according to an aspect of the present disclosure includes a sheet member. A target object to be packaged is to be placed on the sheet member. The sheet member includes a placement surface, a standing side, and a tongue piece. The placement surface allows the target object to be placed thereon. The standing side is elongated from the placement surface. The standing side is raised relative to the placement surface. The placement surface and the standing side are provided with the tongue piece. The tongue piece includes a protrusion edge. The tongue piece is located on a side of at least one side edge of the standing side.

In an embodiment, the tongue piece is in contact with a side edge of the standing side or the placement surface.

In an embodiment, the tongue piece further includes a taper. The taper is obliquely elongated towards the protrusion edge with the tongue piece becoming gradually narrower in width.

In an embodiment, the placement surface or the standing side is further provided with a rise-height section. The tongue piece is in contact with the rise-height section with the standing side raised.

In an embodiment, the tongue piece is bent in a V shape in side view so that the protrusion edge corresponds to a vertex of the V-shape in side view.

In an embodiment, the protrusion edge protrudes outside the standing side.

In an embodiment, the protrusion edge protrudes outside the placement surface.

In an embodiment, the standing side is provided with an opening in at least part of an area of the standing side adjacent to the tongue piece.

In an embodiment, the placement surface is provided with an opening in at least part of an area of the placement surface adjacent to the tongue piece.

In an embodiment, the packaging kit further includes a center tongue piece. The center tongue piece includes a center protrusion edge. The placement surface and the standing side are provided with the center tongue piece. The center tongue piece is located on a center side of the standing side rather than the tongue piece.

In an embodiment, the standing side is provided with an opening in at least part of an area of the standing side adjacent to the center tongue piece.

In an embodiment, the placement surface is provided with an opening in at least part of an area of the placement surface adjacent to the center tongue piece.

In an embodiment, the sheet member further includes a top flap elongated from the standing side. The protrusion edge protrudes below the placement surface. A recess is formed in an area of the top flap on a side of a boundary of the top flap and the standing side. The recess is located at a position corresponding to the protrusion edge.

In an embodiment, the sheet member further includes a top flap. The protrusion edge protrudes below the placement surface. The top flap includes a cut. The cut is located at a position corresponding to the protrusion edge.

A packaging set according to an aspect of the present disclosure includes the above-described packaging kit, and a holder. A holder is to be placed on the placement surface with the holder holding the target object.

In an embodiment, the holder includes a film, and a holder sheet member. The film is attached to the holder sheet member.

DETAILED DESCRIPTION

Figure 1:
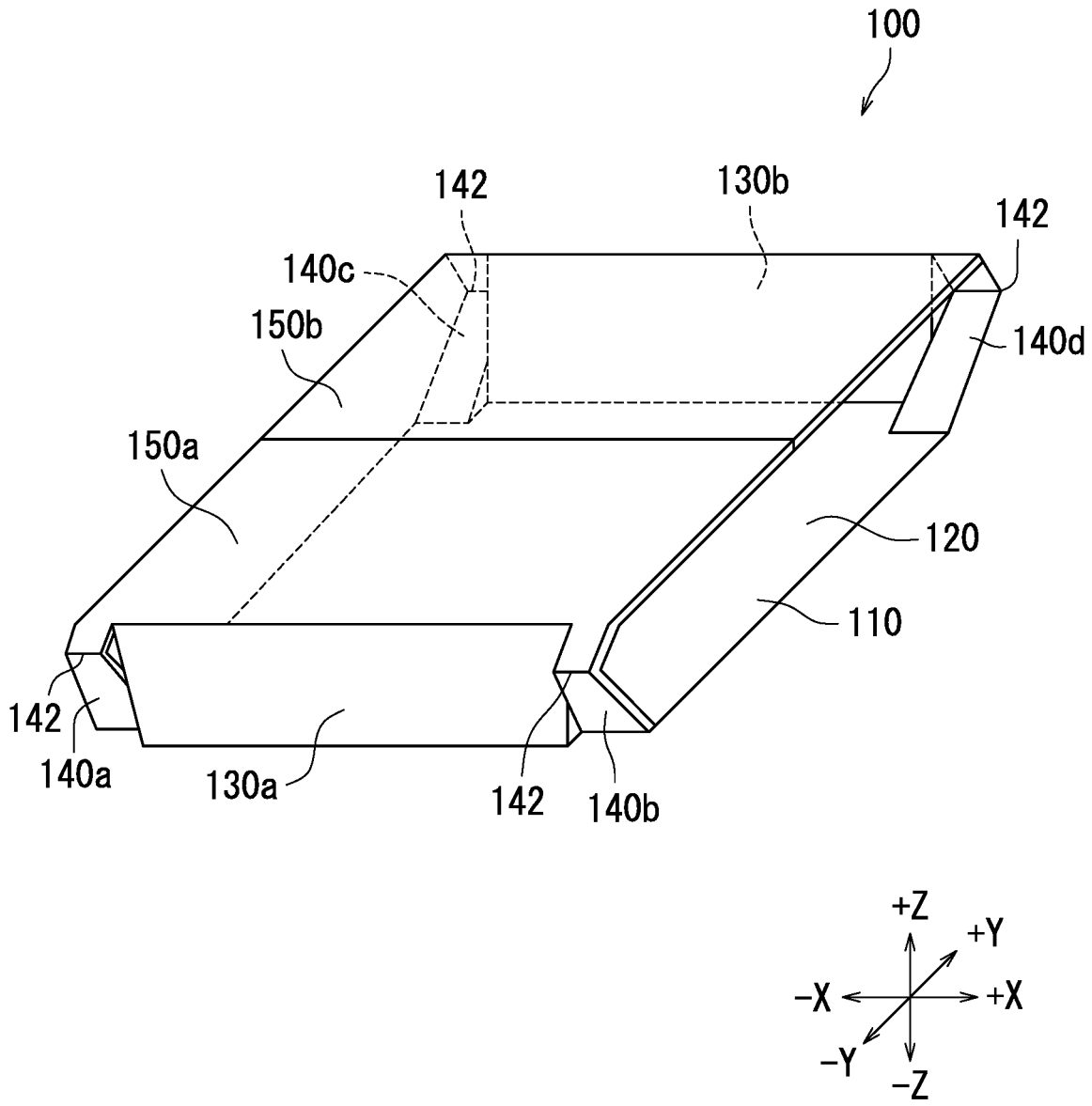
FIG. 1 is a schematic perspective view of a packaging kit according to a first embodiment of the present disclosure.

Embodiments of the present disclosure will hereinafter be described with reference to the drawings. Note that identical or equivalent elements have been allocated identical reference numerals, and description thereof has been omitted as appropriate.

First Embodiment

A packaging kit 100 according to a first embodiment of the present disclosure will be described with reference to FIG. 1. FIG. 1 is a schematic perspective view of the packaging kit 100 according to the first embodiment of the present disclosure. In the description below, as illustrated in FIG. 1, an X-axial direction, a Y-axial direction, and a Z-axial direction are also called a left-right direction, a front-back direction, and a vertical direction, respectively. Here, a direction that is positive on the X-axis when viewed from the origin is a right direction. A direction that is positive on the Y-axis when viewed from the origin is a back direction. The Z-axial direction is a direction perpendicular to a XY plane, and a direction that is positive on the Z-axis when viewed from the origin is an upper direction.

As illustrated in FIG. 1, the packaging kit 100 includes a sheet member 110. The packaging kit 100 allows packaging of a target object to be packaged. The target object is to be placed on the sheet member 110.

The sheet member 110 includes a placement surface 120, two standing sides (a standing side 130*a* and a standing side 130*b*), four tongue pieces (a tongue piece 140*a*, a tongue piece 140*b*, a tongue piece 140*c*, and a tongue piece 140*d*), and top flaps (a top flap 150*a* and a top flap 150*b*). The sheet member 110 is made of, for example a sheet of cardboard.

In the present specification, the standing side 130*a* and the standing side 130*b* may also collectively be referred to as standing sides 130. In the present specification, the tongue piece 140*a*, the tongue piece 140*b*, the tongue piece 140*c*, and the tongue piece 140*d* may also collectively be referred to as tongue pieces 140. In the present specification, the top flap 150*a* and the top flap 150*b* may also collectively be referred to as top flaps 150.

The placement surface 120 allows the target object to be placed thereon.

The standing side 130*a* and the standing side 130*b* are elongated from the placement surface 120. The standing side 130*a* and the standing side 130*b* are raised relative to the placement surface 120. The standing side 130*a* and the standing side 130*b* are bent towards a Z-axis positive direction relative to the placement surface 120. The standing side 130*a* and the standing side 130*b* face to each other.

The placement surface 120 and the standing side 130 are provided with the tongue pieces 140. Specifically, the placement surface 120 and the standing side 130*a* are provided with the tongue piece 140*a* and the tongue piece 140*b*. The placement surface 120 and the standing side 130*b* are provided with the tongue piece 140*c* and the tongue piece 140*d*. The packaging kit 100 is provided with a tongue piece 140 located on a side of at least one side edge of each standing side 130. Specifically, the tongue piece 140*a* and the tongue piece 140*b* are located at respective sides of both side edges of the standing side 130*a*. The tongue piece 140*c* and the tongue piece 140*d* are located at respective sides of both side edges of the standing side 130*b*. Each tongue piece 140 is in contact with a side edge of a corresponding standing side 130. Specifically, the tongue piece 140*a* and the tongue piece 140*b* are in contact with both the side edges of the standing side 130*a*. The tongue piece 140*c* and the tongue piece 140*d* are in contact with both the side edges of the standing side 130*b*. Each tongue piece 140 is therefore engaged with a corresponding standing side 130. Each of the tongue pieces 140*a* to 140*d* has a protrusion edge 142. The protrusion edges 142 will be described later with reference to FIG. 2.

Each top flap 150 is elongated from a corresponding standing side 130. Specifically, the top flap 150*a* is elongated from the standing side 130*a*. The top flap 150*b* is elongated from the standing side 130*b*. The top flap 150*a* is bent towards a Y-axis positive direction relative to the standing side 130*a*. The top flap 150*b* is bent towards a Y-axis negative direction relative to the standing side 130*b*.

Figure 2:
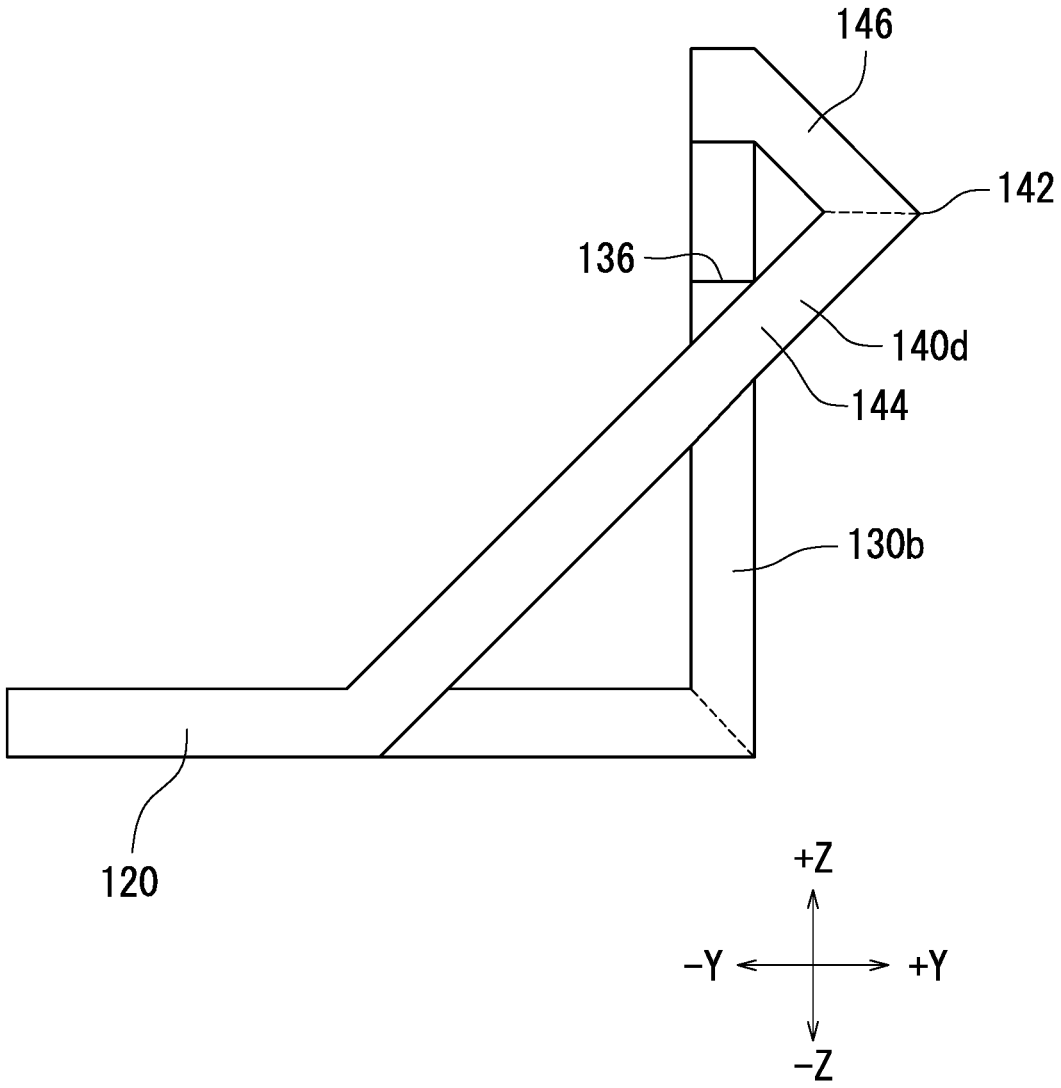
FIG. 2 is a schematic side view of an area adjacent to a tongue piece provided for the packaging kit according to the first embodiment of the present disclosure.

Hereinafter, the tongue pieces 140 will further be described with reference to FIG. 2. FIG. 2 is a schematic side view of an area adjacent to the tongue piece 140*d* of the packaging kit 100 according to the first embodiment of the present disclosure.

As illustrated in FIG. 2, the tongue piece 140*d* includes a body section 144 and a coupling section 146 besides the protrusion edge 142. With the standing side 130*d* raised, the tongue piece 140*d* is bent in a V shape in side view (by about 90 degrees) so that the protrusion edge 142 corresponds to a vertex of the V shape in side view.

The protrusion edge 142 protrudes outside the standing side 130*b* with the standing side 130*b* raised.

The body section 144 is elongated from the placement surface 120. With the standing side 130 raised, one part of the body section 144 is located inside the standing side 130*b*, while the other part of the body section 144 is located outside the standing side 130*b*. Length of the body section 144 is longer than length of the coupling section 146.

The coupling section 146 is continuous between the top flap 150 (see FIG. 1) and the body section 144. The coupling section 146 is located outside the standing side 130*b* with the standing side 130 raised.

The standing side 130*b* has, for example two rise-height sections 136. The body section 144 is in pressure contact with the rise-height sections 136 with the standing side 130 raised. Each tongue piece 140 is therefore engaged with a corresponding standing side 130.

Figure 3A:
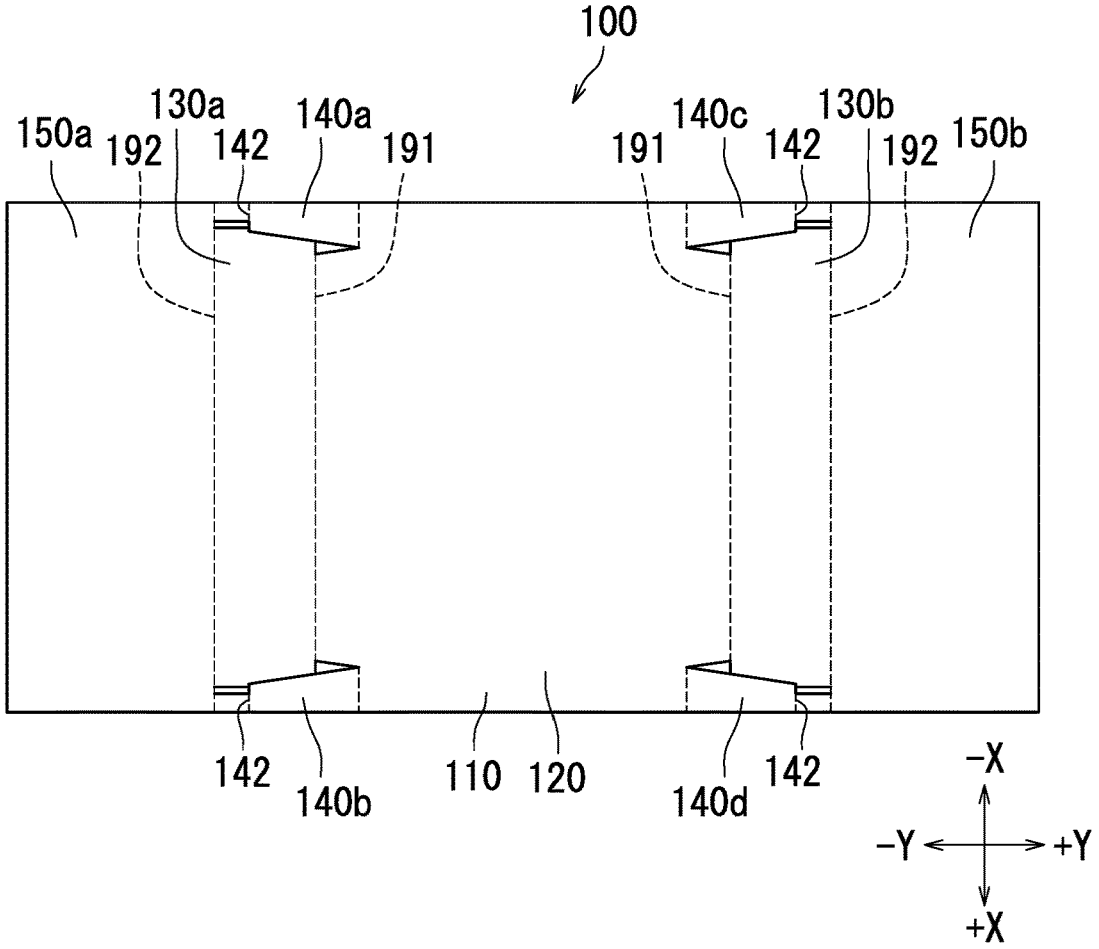
FIG. 3A is a development plan of the packaging kit according to the first embodiment of the present disclosure.
Figure 3B:
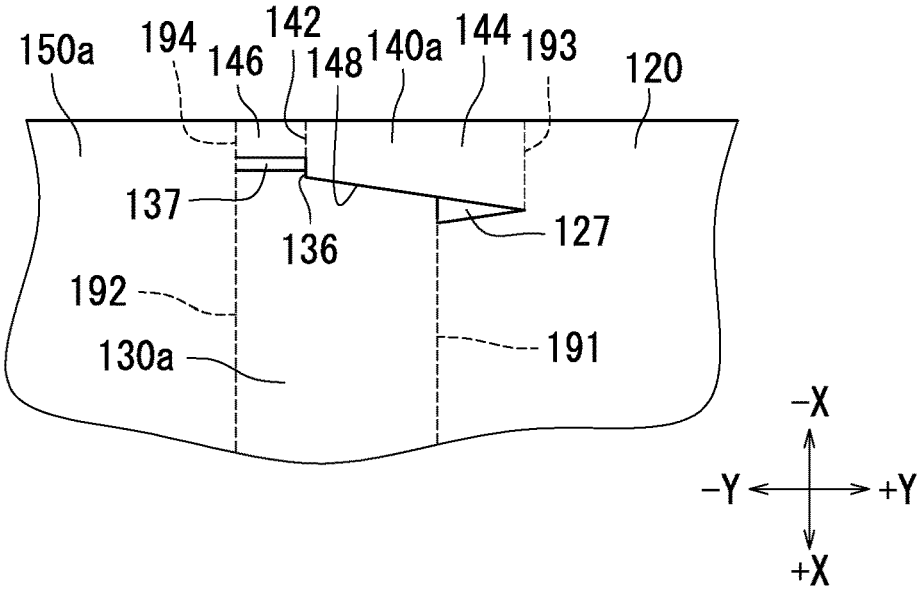
FIG. 3B is an enlarged view of an area adjacent to a tongue piece provided for the packaging kit according to the first embodiment of the present disclosure.

The packaging kit 100 according to the first embodiment of the present disclosure will further be described with reference to FIGS. 3A and 3B. FIG. 3A is a development (or net) plan of the packaging kit 100 according to the first embodiment of the present disclosure. FIG. 3B is an enlarged view of an area adjacent to the tongue piece 140*a* provided for the packaging kit 100 according to the first embodiment of the present disclosure.

As illustrated in FIGS. 3A and 3B, the sheet member 110 is provided with two fold lines 191, two fold lines 192, four fold lines 193, and four fold lines 194. The fold lines 191, the fold lines 192, the fold lines 193, and the fold lines 194 extend along the X-axial direction. The respective fold lines 191 allow the standing side 130*a* and the standing side 130*b* to be bent relative to the placement surface 120. One of the fold lines 192 allows the top flap 150*a* to be bent relative to the standing side 130*a*. The other of the fold line 192 allows the top flap 150*b* to be bent relative to the standing side 130*b*.

As illustrated in FIG. 3B, each body section 144 is substantially trapezoid in shape. An end edge of the body section 144 on the side of the Y-axis positive direction and the placement surface 120 are continuous across the fold line 193. The fold line 193 functions as a pivot to allow the body section 144 to be turned around the fold line 193 relative to the placement surface 120.

The coupling section 146 is rectangular. An end edge of the coupling section 146 on the side of the Y-axis negative direction, and the top flap 150*a* are continuous across the fold line 194. The fold line 194 functions as a pivot to allow the coupling section 146 to be turned around the fold line 194 relative to the standing side 130*a*.

The tongue piece 140*a* further includes a taper 148 besides the protrusion edge 142, the body section 144, and the coupling section 146. The taper 148 is obliquely elongated towards the protrusion edge 142 with the tongue piece 140*a* becoming gradually narrower in width. The body section 144 therefore becomes gradually narrower in width towards the standing side 130 from the placement surface 120.

The placement surface 120 is provided with four openings 127. In the present embodiment, each opening 127 is triangular. Each opening 127 is located in an area of the placement surface 120 adjacent to a corresponding tongue piece 140. Specifically, each opening 127 is located in at least part of the area of the placement surface 120 adjacent to the corresponding body section 144. In short, each opening 127 is provided in an internal corner of the fold line 191, and part of the body section 144 on the side of the placement surface 120. This therefore facilitates raising the standing side 130 when the standing side 130 is raised along the fold line 191 because friction generated between the standing side 130 and the tongue piece 140 is reduced. Furthermore, when the standing side 130 is raised along the fold line 191, it is possible to prevent the body section 144 from easily being bent due to the influence of the standing side 130 being bent.

Each standing side 130 is provided with two openings 137. In the present embodiment, each opening 137 is rectangular. Each opening 137 is located in at least part of an area of the standing side 130 adjacent to a corresponding tongue piece 140. Specifically, each opening 137 is located in an area of the standing side 130 adjacent to a corresponding coupling section 146. In short, the opening 137 is provided in an internal corner of the fold line 192 and the coupling section 146. This therefore facilitates raising the standing side 130 when the standing side 130 is raised along the fold line 191 because friction generated between the standing side 130 and the tongue piece 140 is reduced. Furthermore, when the standing side 130 is raised along the fold line 191, it is possible to prevent the coupling section 146 from easily being bent due to the influence of the standing side 130 being bent.

Second Embodiment

Figure 4:
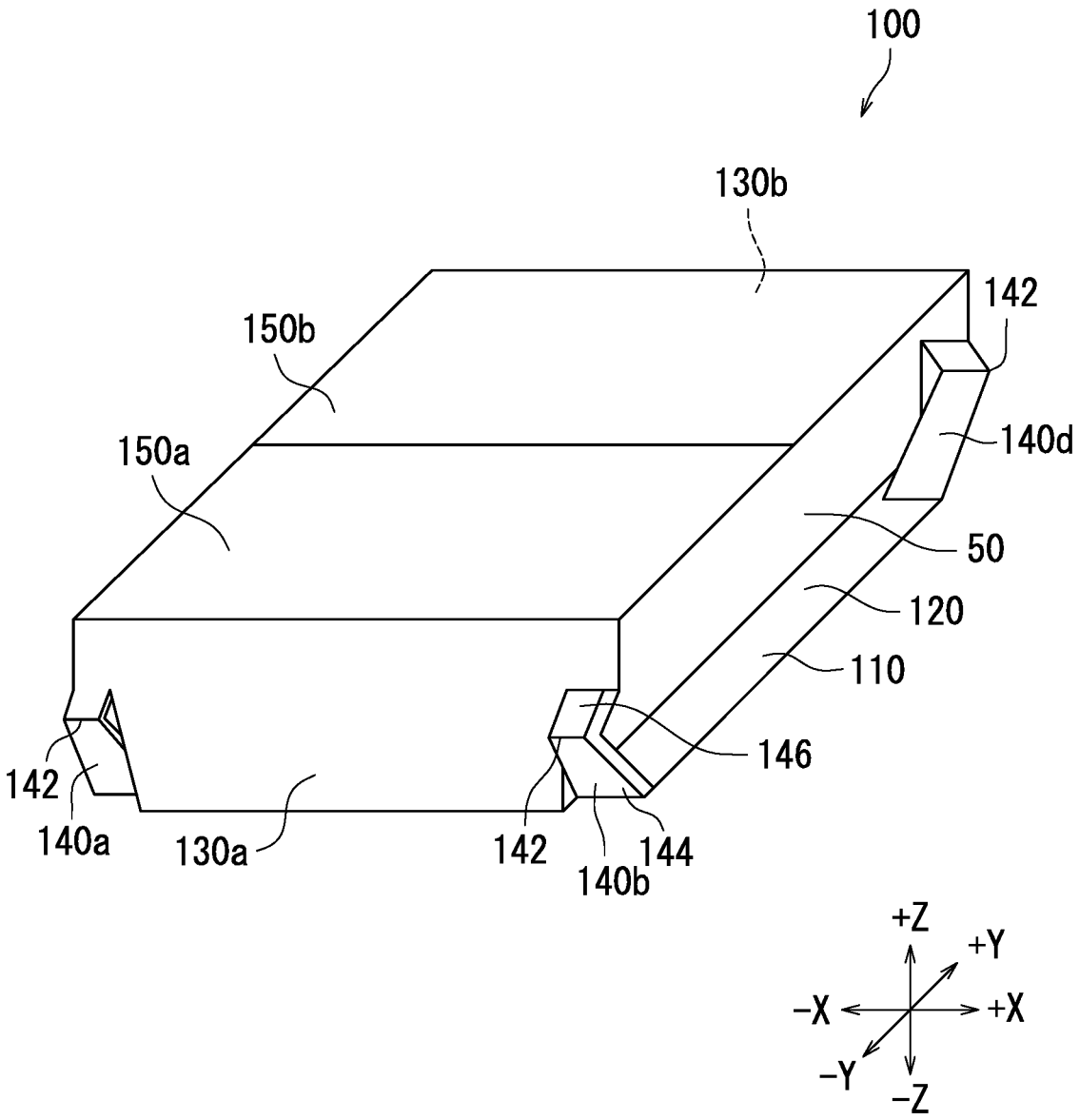
FIG. 4 is a schematic perspective view of a packaging kit according to a second embodiment of the present disclosure.

A packaging kit 100 according to a second embodiment of the present disclosure will be described with reference to FIG. 4. FIG. 4 is a schematic perspective view of the packaging kit 100 according to the second embodiment of the present disclosure. Except that a coupling section 146 of each tongue piece 140 is continuous between a corresponding standing side 130 and a corresponding body section 144, the packaging kit 100 according to the second embodiment has the same configuration as the packaging kit 100 according to the first embodiment, and the description of the same configuration has been omitted.

In the first embodiment the coupling section 146 of each tongue piece 140 and a corresponding top flap 150 are continuous, but in the present embodiment the coupling section 146 of each tongue piece 140 and the standing side 130 are continuous.

Figure 5:
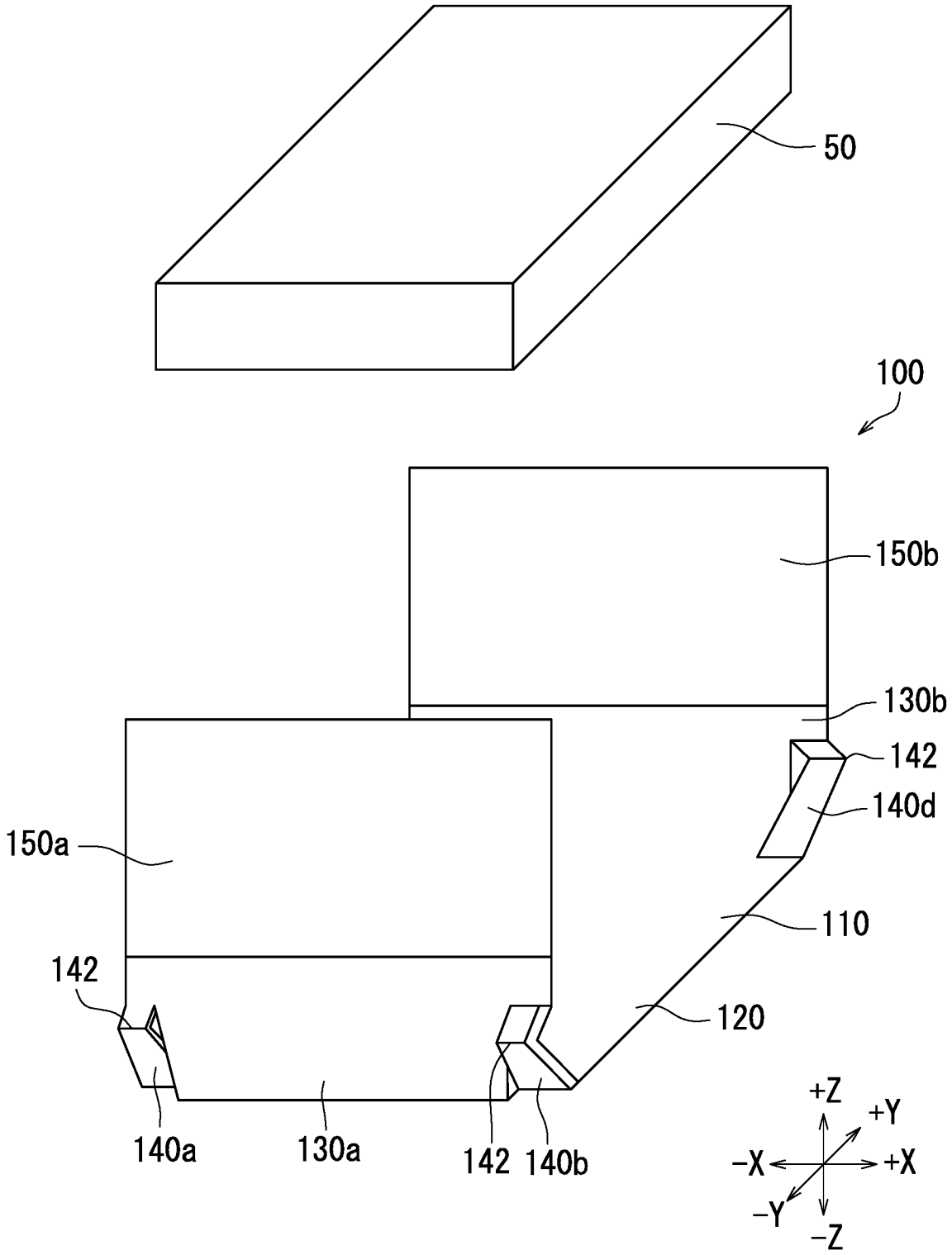
FIG. 5 is a perspective view illustrating a packaging method of a target object to be packaged using the packaging kit.
Figure 6A:
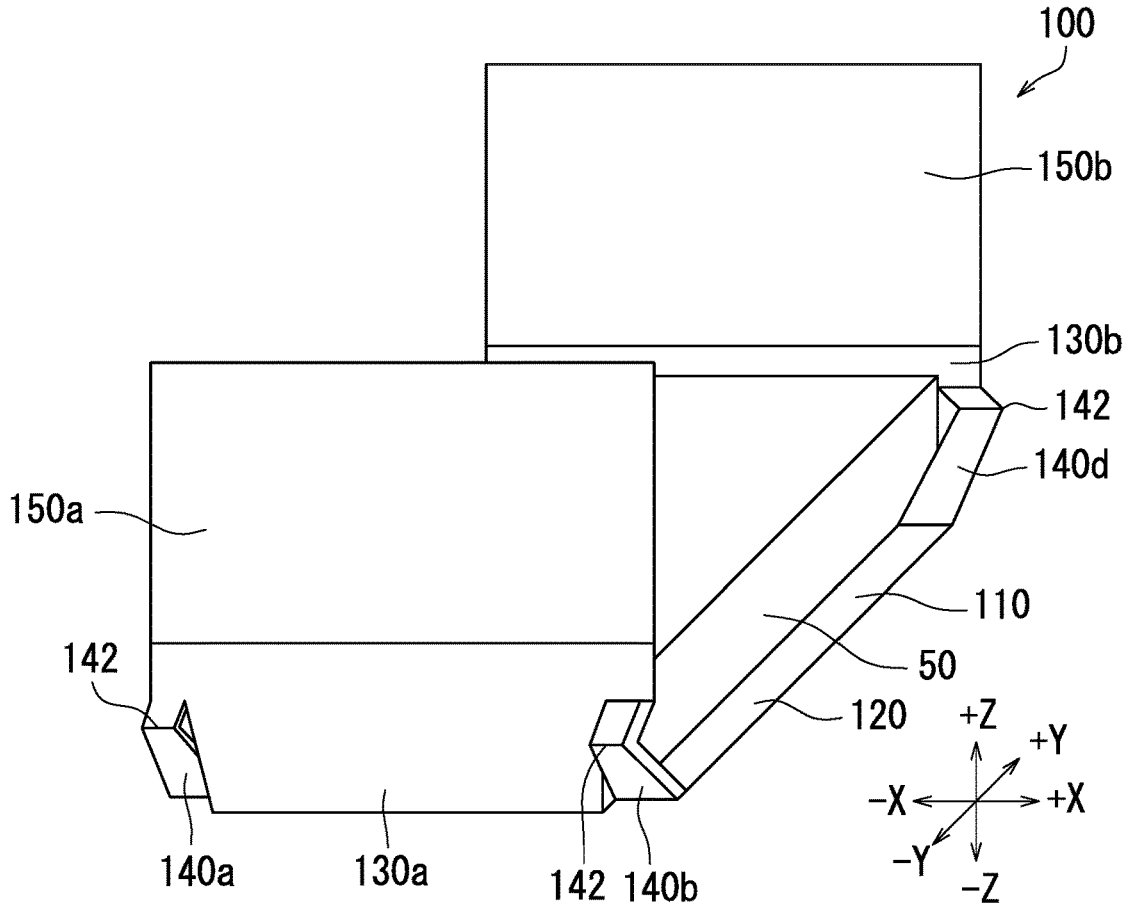
FIGS. 6A and 6B are perspective views illustrating the packaging method of the target object using the packaging kit.
Figure 6B:
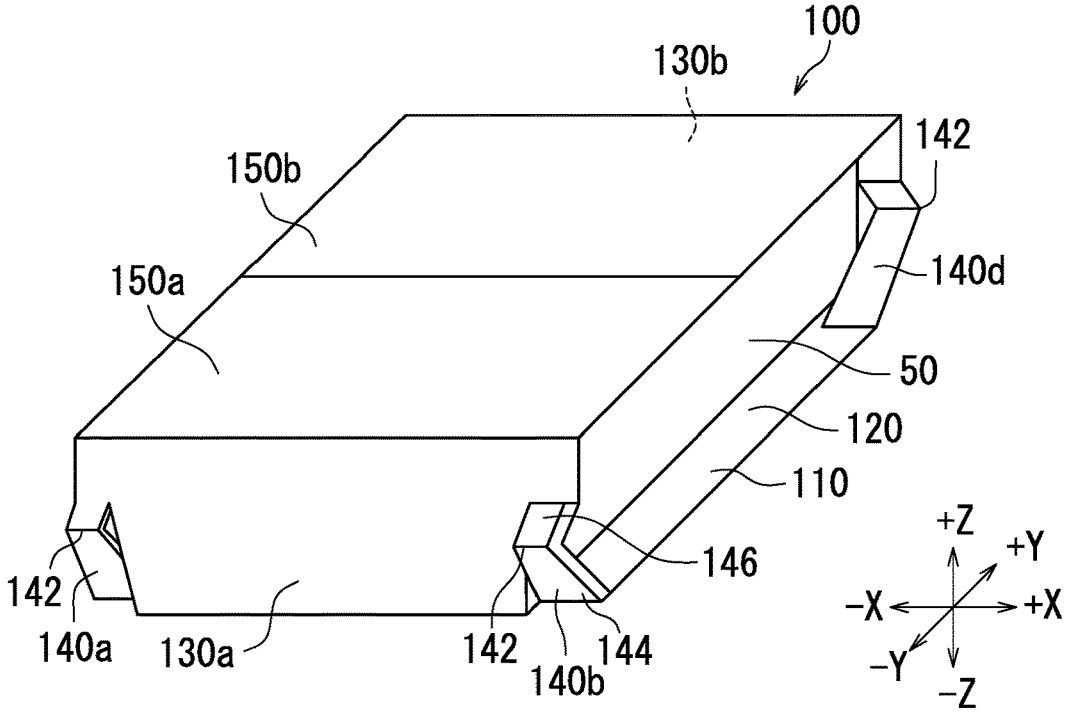

A packaging method of a target object 50 to be packaged using the packaging kit 100 will be described with reference to FIGS. 5, 6A, and 6B. FIGS. 5, 6A, and 6B are perspective views illustrating the packaging method of the target object 50 using the packaging kit 100.

As illustrated in FIG. 5, the target object 50 is a target object to be packaged, which is rectangular cuboid. Width (length along an X-axial direction) of the target object 50 is shorter than a distance between the tongue piece 140*a* and the tongue piece 140*b*. Herein, the width of the target object 50 is slightly shorter than the distance between the tongue piece 140*a* and the tongue piece 140*b*. Length (length along a Y-axial direction) of the target object 50 is shorter than length of the placement surface 120 along the Y-axial direction. Herein, the length of the target object 50 is slightly shorter than the length of the placement surface 120 along the Y-axial direction.

The standing side 130*a* and the standing side 130*b* are first bent towards a Z-axis positive direction. Bending the standing side 130*a* in the Z-axis positive direction enables the tongue piece 140*a* and the tongue piece 140*b* to be engaged with the standing side 130*a*. It is therefore possible to prevent the standing side 130*a* in a standing position from easily restoring with cardboard restoring force. It is consequently possible to keep the standing side 130*a* in the standing position at an angle of about 90 degrees relative to the placement surface 120.

Similarly, bending the standing side 130*b* in the Z-axis positive direction enables the tongue piece 140*c* and the tongue piece 140*d* to be engaged with the standing side 130*b*. It is therefore possible to prevent the standing side 130*b* in a standing position from easily restoring with cardboard restoring force. It is consequently possible to keep the standing side 130*b* in the standing position at an angle of about 90 degrees relative to the placement surface 120.

As illustrated in FIG. 6A, the target object 50 is then placed on the placement surface 120. This enables easy placement of the target object 50 on the placement surface 120 because the standing side 130*a* and the standing side 130*b* are kept in the standing position at the angle of about 90 degrees relative to the placement surface 120.

As illustrated in FIG. 6B, the top flap 150*a* is then bent towards a Y-axis positive direction. The top flap 150*b* is also bent towards a Y-axis negative direction. The top flap 150*a* and the top flap 150*b* are joined with an adhesive tape. The packaging kit 100 is provided with tongue pieces 140 located at respective sides of both side edges of each standing side 130, and therefore the target object 50 is fixed by the tongue pieces 140. It is therefore possible to facilitate packaging the target object 50. It is also possible to prevent the target object 50 from easily being shifted during transportation.

As described above with reference to FIGS. 1 to 6B, each standing side 130 includes a tongue piece 140 located on a side of at least one side edge of the standing side 130. It is therefore possible to easily fix the target object 50 by the tongue pieces 140. It is also possible to prevent each standing side 130 in a standing position from easily restoring with the cardboard restoring force. It is consequently possible to facilitate packaging the target object 50. It is also possible to prevent the target object 50 from easily being shifted during transportation.

Each tongue piece 140 is in contact with a side edge of a corresponding standing side 130. This therefore allows each tongue piece 140 to be engaged with the corresponding standing side 130. It is consequently possible to prevent each standing side 130 in a standing position from easily restoring with the cardboard restoring force. It is consequently possible to keep each standing side 130 in the standing position at the angle of about 90 degrees relative to the placement surface 120.

Each tongue piece 140 also has the taper 148. The taper 148 is obliquely elongated towards a corresponding protrusion edge 142 with the tongue piece 140 becoming gradually narrower in width. It is therefore possible to easily engage each tongue piece 140 with the corresponding standing side 130 because the taper 148 is provided so that the tongue piece 140 becomes gradually wider in width towards the placement surface 120.

Third Embodiment

Figure 7:
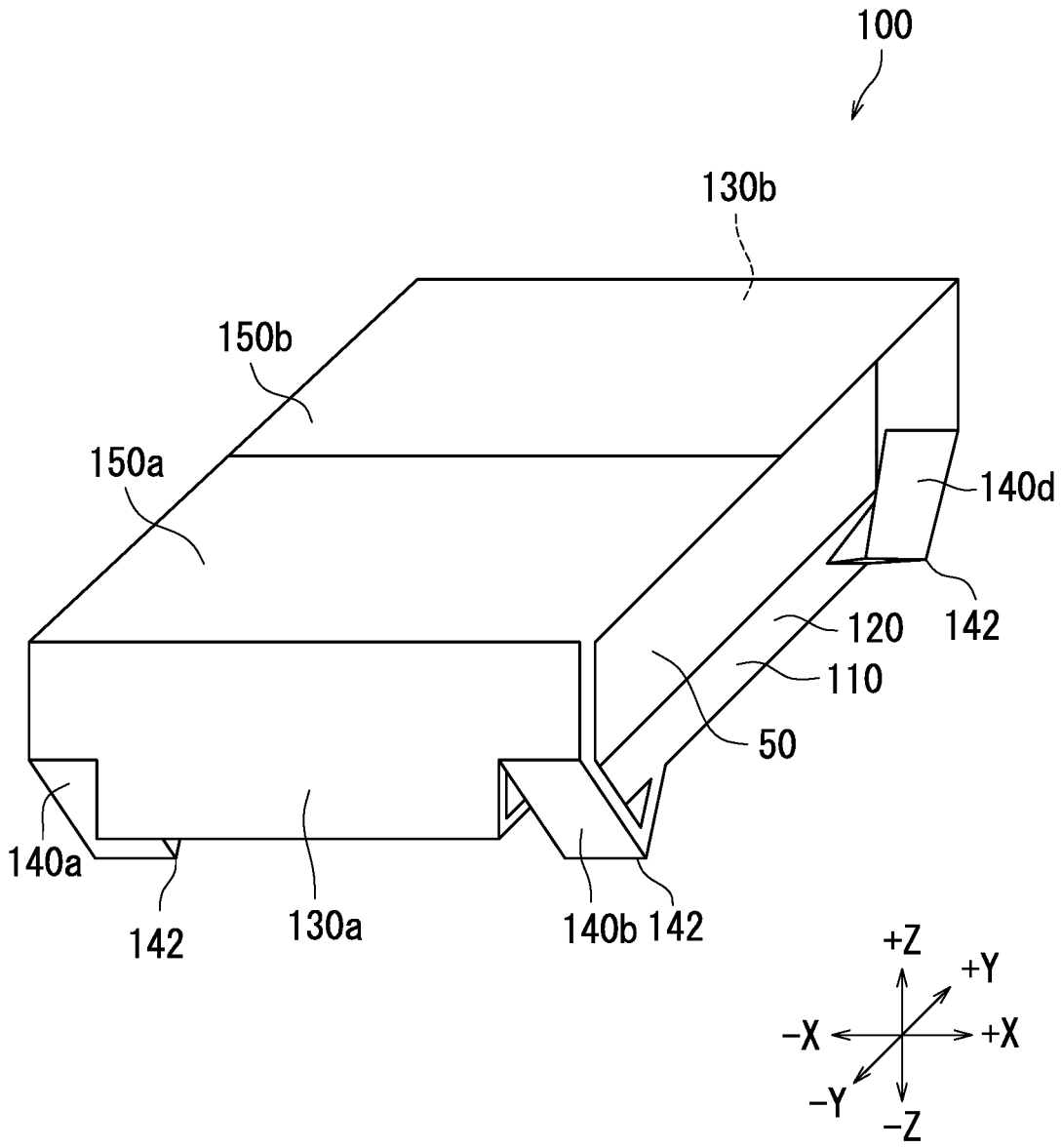
FIG. 7 is a schematic perspective view of a packaging kit according to a third embodiment of the present disclosure.

A packaging kit 100 according to a third embodiment of the present disclosure will be described with reference to FIG. 7. FIG. 7 is a schematic perspective view of the packaging kit 100 according to the third embodiment of the present disclosure. Except that a protrusion edge 142 of each tongue piece 140 protrudes outside a placement surface 120, the packaging kit 100 according to the third embodiment has the same configuration as the packaging kit 100 according to the first embodiment, and the description of the same configuration has been omitted.

In the first embodiment the protrusion edge 142 of each tongue piece 140 protrudes outside the standing side 130, whereas in the present embodiment the protrusion edge 142 of each tongue piece 140 protrudes outside the placement surface 120 as illustrated in FIG. 7. Specifically, each protrusion edge 142 protrudes below the placement surface 120.

Also in the present embodiment, in the same way as the first embodiment, each tongue piece 140 is bent in a V shape in side view (by about 90 degrees) with the standing side 130 raised so that the protrusion edge 142 thereof corresponds to a vertex of the V shape in side view. Each tongue piece 140 is in contact with a side edge of the placement surface 120. This therefore allows each tongue piece 140 to be engaged with the placement surface 120.

Figure 8A:
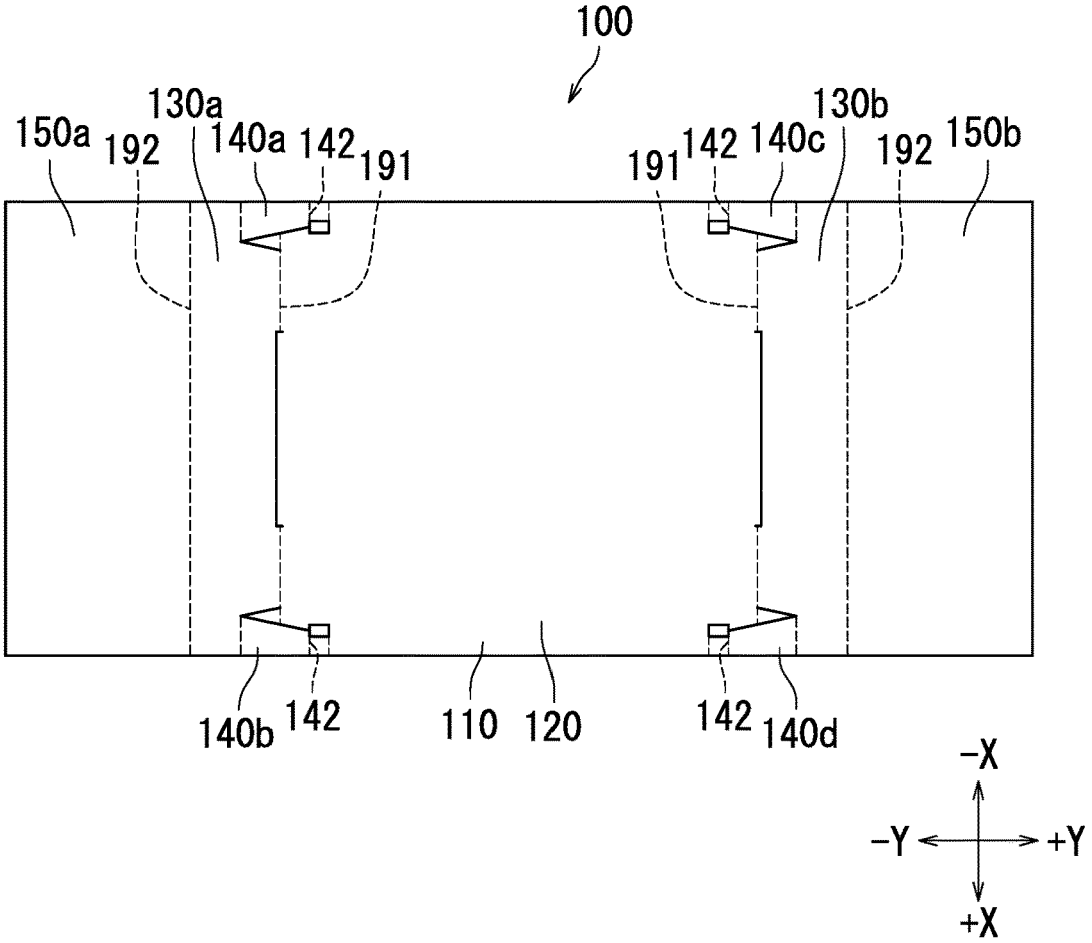
FIG. 8A is a development plan of the packaging kit according to the third embodiment of the present disclosure.
Figure 8B:
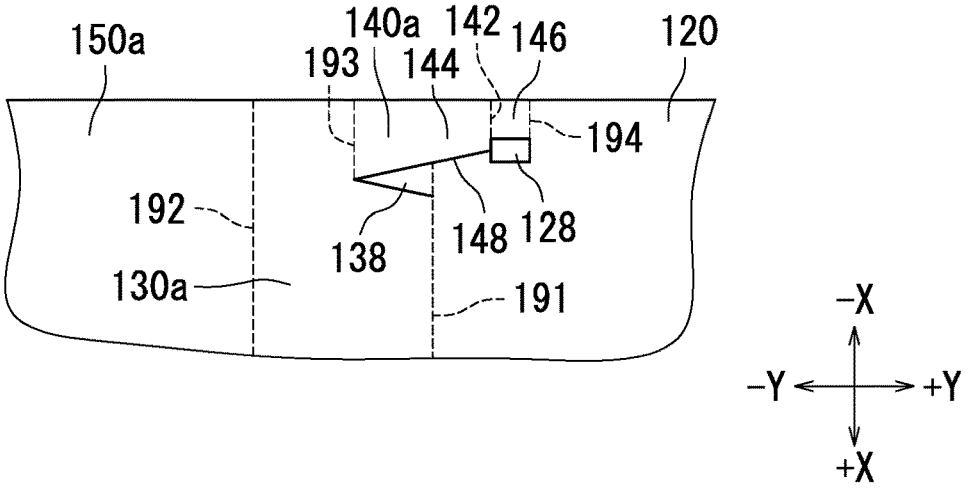
FIG. 8B is an enlarged view of an area adjacent to a tongue piece provided for the packaging kit according to the third embodiment of the present disclosure.

The packaging kit 100 according to the third embodiment of the present disclosure will be described in detail with reference to FIGS. 8A and 8B. FIG. 8A is a development plan of the packaging kit 100 according to the third embodiment of the present disclosure. FIG. 8B is an enlarged view of an area adjacent to a tongue piece 140*a* provided for the packaging kit 100 according to the third embodiment of the present disclosure.

As illustrated in FIGS. 8A and 8B, two fold lines 191, two fold lines 192, four fold lines 193, and four fold lines 194 are formed on a sheet member 110. The fold lines 191, the fold lines 192, the fold lines 193, and the fold lines 194 are elongated along an X-axial direction. The fold lines 191 allow a standing side 130*a* and a standing side 130*b* to be bent relative to a placement surface 120. One of the fold lines 192 allows a top flap 150*a* to be bent relative to the standing side 130*a*. The other of the fold lines 192 allows a top flap 150*b* to be bent relative to the standing side 130*b*.

As illustrated in FIG. 8B, each body section 144 is substantially trapezoid in shape. In the figure, an end edge of the body section 144 on the side of a Y-axis negative direction and a standing side 130 are continuous across the fold line 193. The fold line 193 functions as a pivot to allow the body section 144 to be turned around the fold line 193 relative to the standing side 130.

Each coupling section 146 is rectangular. In the figure, an end edge of the coupling section 146 on the side of a Y-axis positive direction, and the placement surface 120 are continuous across the fold line 194. The fold line 194 functions as a pivot to allow the coupling section 146 to be turned around the fold line 194 relative to the placement surface 120.

The tongue piece 140*a* has a taper 148 besides the protrusion edge 142, the body section 144, and the coupling section 146. The taper 148 is obliquely elongated towards the protrusion edge 142 with the tongue piece 140*a* becoming gradually narrower in width. The body section 144 therefore becomes gradually narrower in width towards the placement surface 120 from the standing side 130.

Each standing side 130 is provided with two openings 138. In the present embodiment, each opening 138 is triangular. The opening 138 is located in an area of the standing side 130 adjacent to the tongue piece 140. Specifically, the opening 138 is located in at least part of the area of the standing side 130 adjacent to the body section 144. In short, the opening 138 is provided at an internal corner of the fold line 191 and part of the body section 144 on the side of the standing side 130. This therefore facilitates raising the standing side 130 when the standing side 130 is raised along the fold line 191 because friction generated between the standing side 130 and the tongue piece 140 is reduced. Furthermore, it is possible to prevent the body section 144 from easily being bent due to the influence of the standing side 130 being bent when the standing side 130 is raised along the fold line 191.

The placement surface 120 is provided with four openings 128. In the present embodiment, each opening 128 is rectangular. Each opening 128 is located in at least part of an area of the placement surface 120 adjacent to a corresponding tongue piece 140. Specifically, the opening 128 is located in an area of the placement surface 120 adjacent to a corresponding coupling section 146. It is therefore possible to facilitate raising the standing side 130 when the standing side 130 is raised along the fold line 191 because friction generated between the standing side 130 and the tongue piece 140 is reduced. Furthermore, it is possible to prevent the coupling section 146 from easily being bent due to the influence of the standing side 130 being bent when the standing side 130 is raised along the fold line 191.

Figure 9:
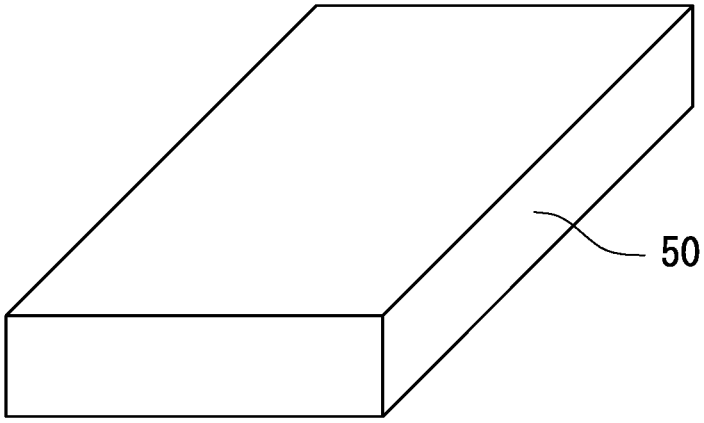
FIG. 9 is a perspective view illustrating a packaging method of a target object to be packaged using the packaging kit.
Figure 9:
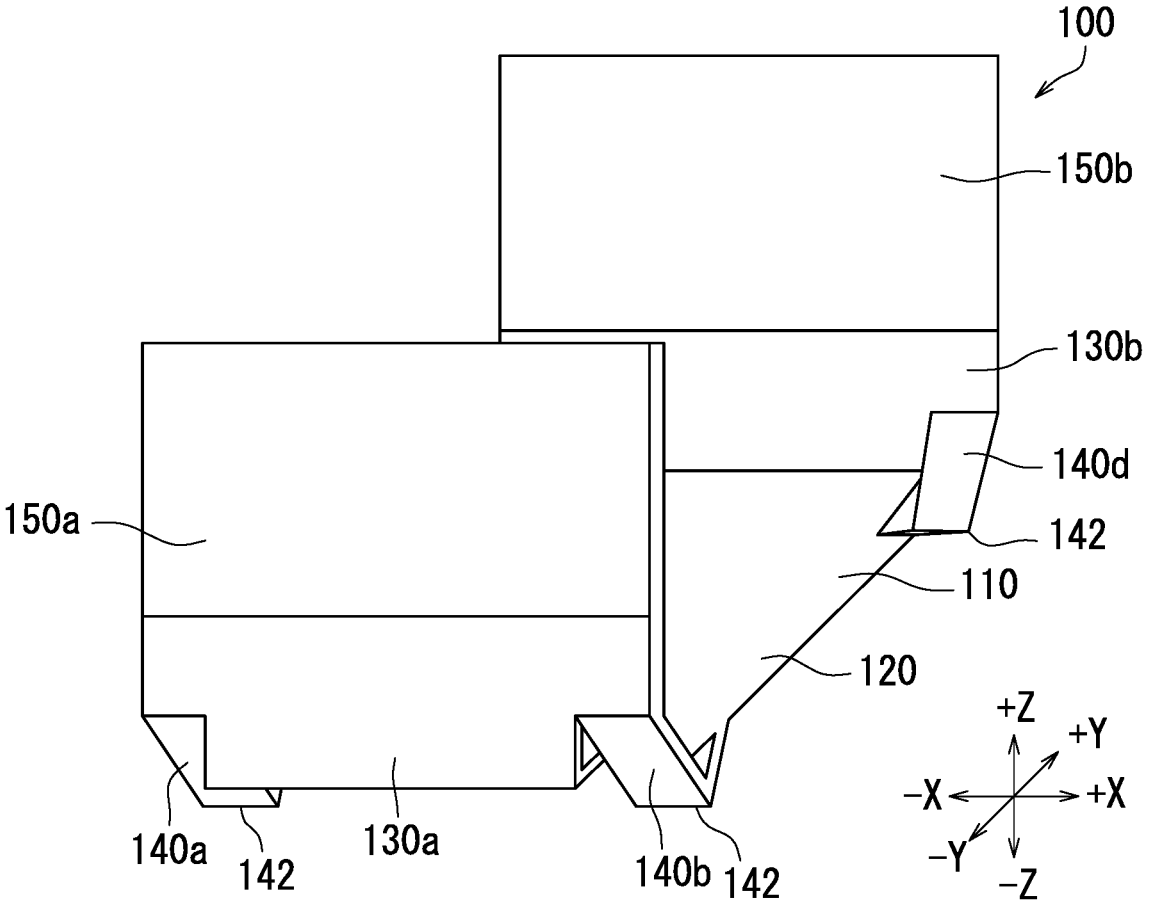
Figure 10A:
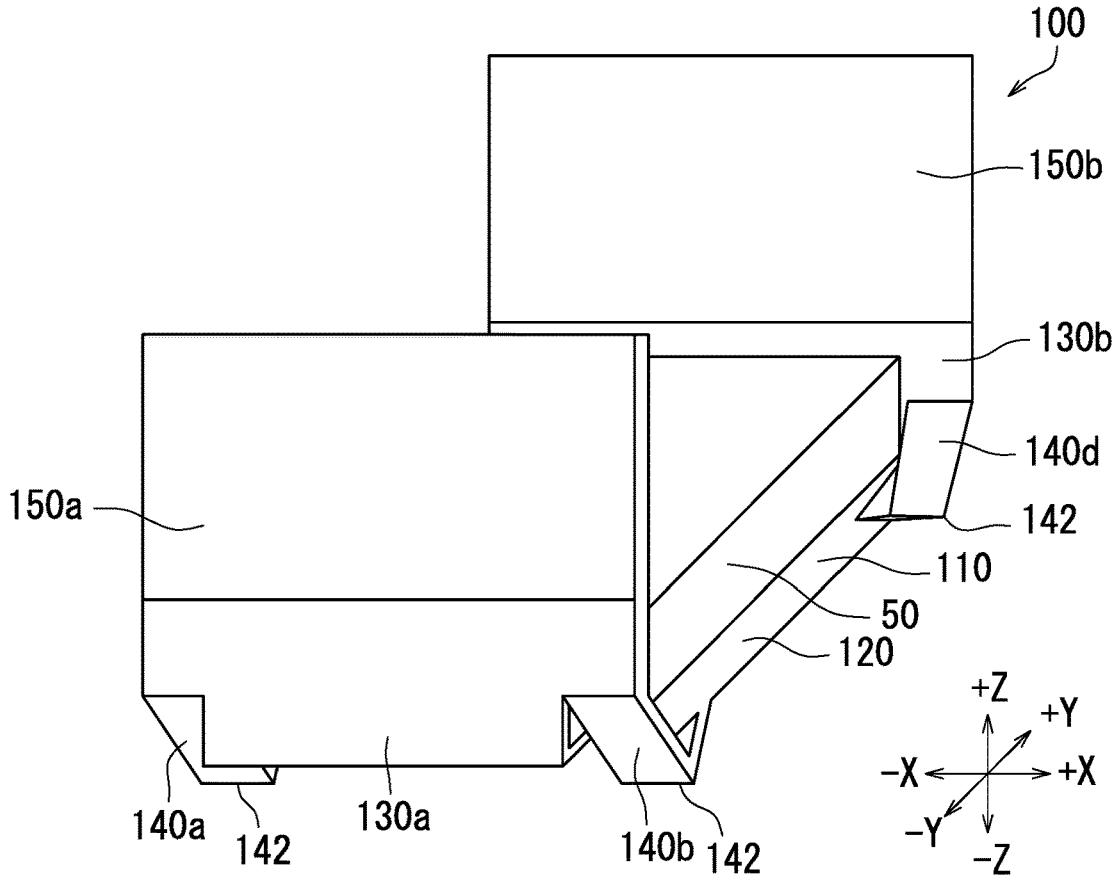
FIGS. 10A and 10B are perspective views illustrating the packaging method of the target object using the packaging kit.
Figure 10B:
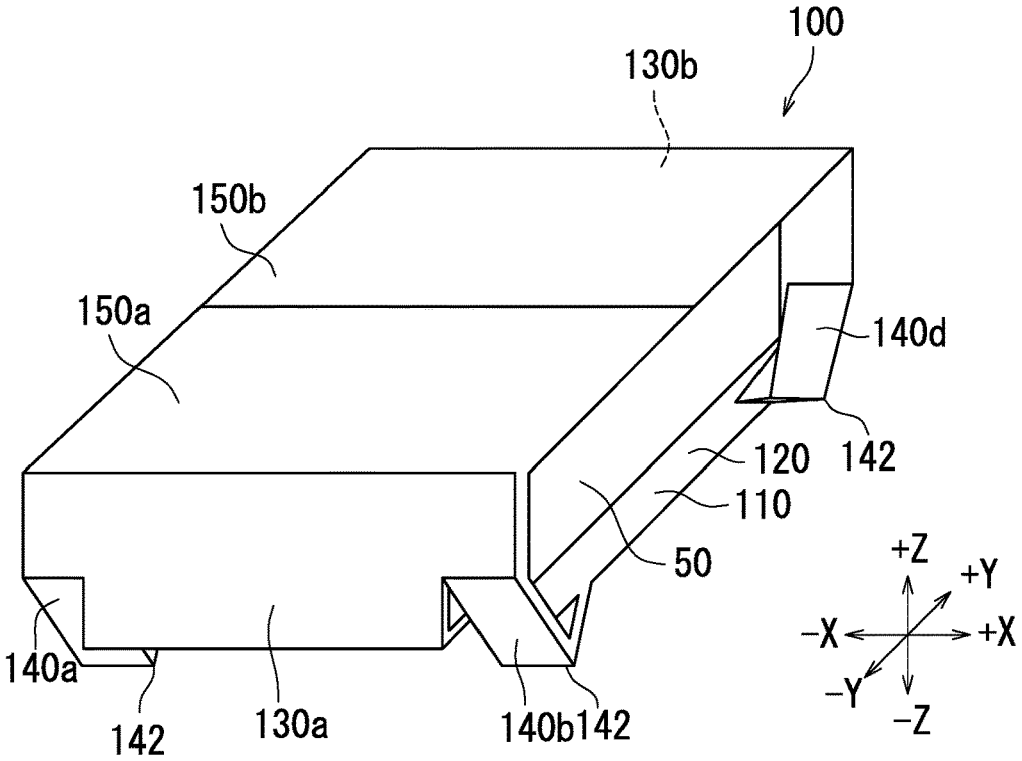

A packaging method of a target object 50 to be packaged using the packaging kit 100 will be described with reference to FIGS. 9, 10A, and 10B. FIGS. 9, 10A, and 10B are perspective views illustrating the packaging method of the target object 50 using the packaging kit 100.

As illustrated in FIG. 9, the target object 50 is a target object to be packaged, which is rectangular cuboid. Width (length along the X-axial direction) of the target object 50 is shorter than a distance between the tongue piece 140*a* and a tongue piece 140*b*. Herein, the width of the target object 50 is slightly shorter than the distance between the tongue piece 140*a* and the tongue piece 140*b*. Length (length along a Y-axial direction) of the target object 50 is shorter than length of the placement surface 120 along the Y-axial direction. Herein, the length of the target object 50 is slightly shorter than the length of the placement surface 120 along the Y-axial direction.

The standing side 130*a* and the standing side 130*b* are first bent towards a Z-axis positive direction. Bending the standing side 130*a* in the Z-axis positive direction enables the tongue piece 140*a* and the tongue piece 140*b* to be engaged with the placement surface 120. It is therefore possible to prevent the standing side 130*a* in a standing position from easily restoring with cardboard restoring force. It is therefore possible to keep the standing side 130*a* in the standing position at an angle of about 90 degrees relative to the placement surface 120.

Similarly, bending the standing side 130*b* in the Z-axis positive direction enables a tongue piece 140*c* and a tongue piece 140*d* to be engaged with the placement surface 120. It is therefore possible to prevent the standing side 130*b* in a standing position from easily restoring with cardboard restoring force. It is consequently possible to keep the standing side 130*b* in the standing position at an angle of about 90 degrees relative to the placement surface 120.

As illustrated in FIG. 10A, the target object 50 is then placed on the placement surface 120. This enables easy placement of the target object 50 on the placement surface 120 because the standing side 130*a* and the standing side 130*b* is kept in the standing position at the angle of about 90 degrees relative to the placement surface 120.

As illustrated in FIG. 10B, the top flap 150*a* is then bent towards the Y-axis positive direction. The top flap 150*b* is also bent towards the Y-axis negative direction. The top flap 150*a* and the top flap 150*a* are joined with an adhesive tape. The packaging kit 100 is provided with tongue pieces 140 located at respective sides of both side edges of each standing side 130, and therefore the target object 50 is fixed by the tongue pieces 140. It is therefore possible to prevent the target object 50 from easily being shifted during transportation.

Fourth Embodiment

Figure 11:
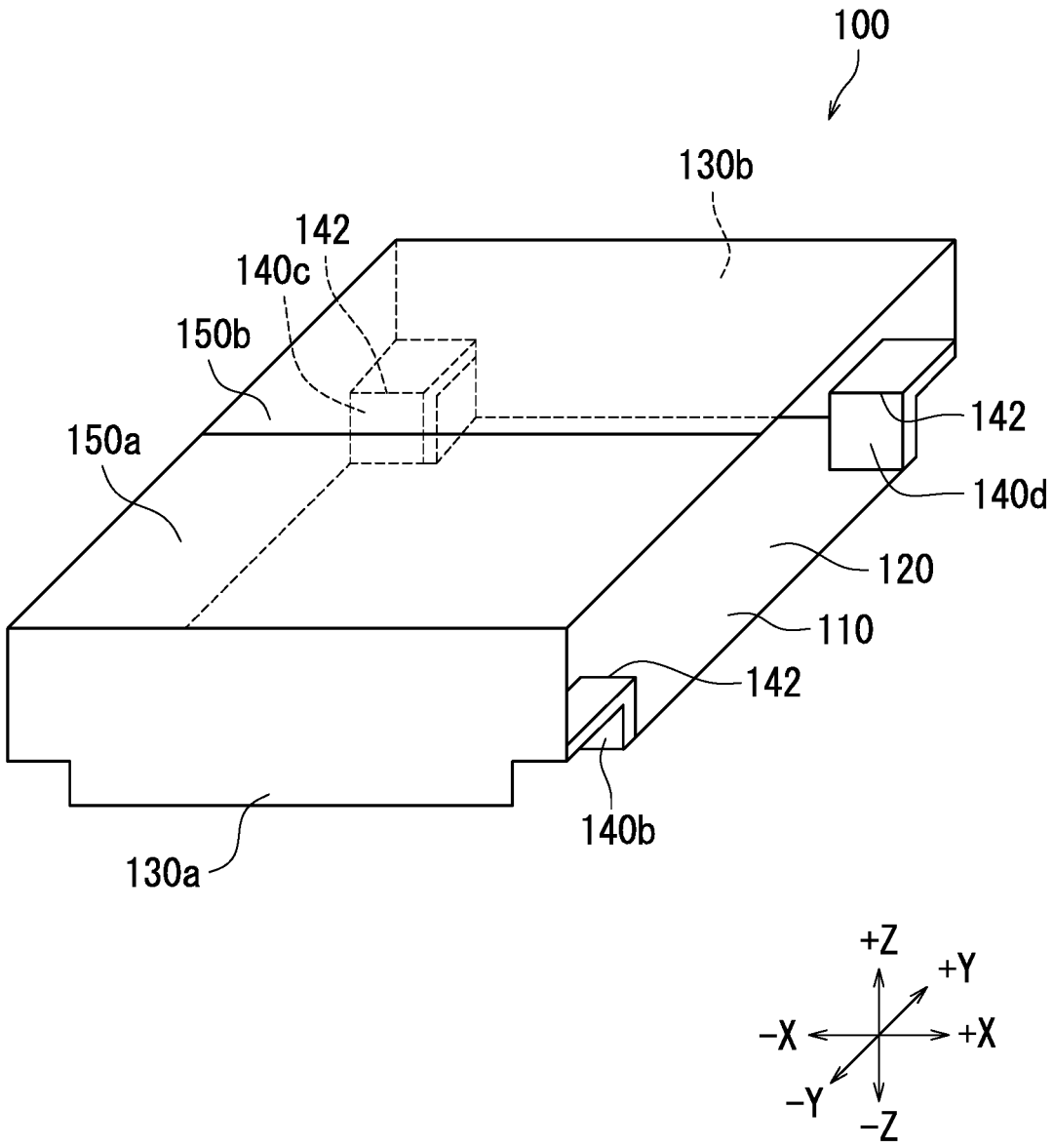
FIG. 11 is a schematic perspective view of a packaging kit according to a fourth embodiment of the present disclosure.
Figure 12:
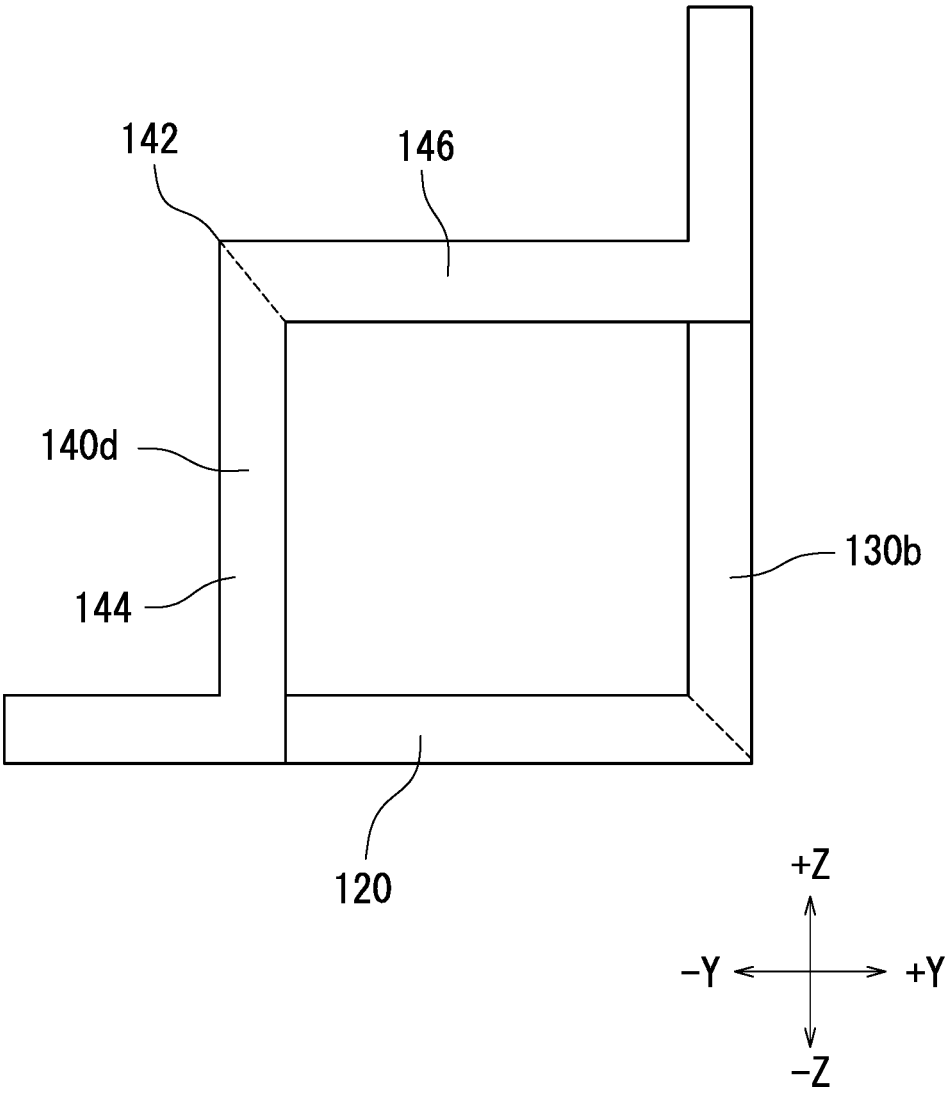
FIG. 12 is a schematic side view of an area adjacent to a tongue piece provided for the packaging kit according to the fourth embodiment of the present disclosure.

A packaging kit 100 according to a fourth embodiment of the present disclosure will be described with reference to FIGS. 11 and 12. FIG. 11 is a schematic perspective view of the packaging kit 100 according to the fourth embodiment of the present disclosure. FIG. 12 is a schematic side view of an area adjacent to a tongue piece 140*d* provided for the packaging kit 100 according to the fourth embodiment of the present disclosure. Except that a protrusion edge 142 of each tongue piece 140 protrudes inside a placement surface 120 and a standing side 130, the packaging kit 100 according to the fourth embodiment has the same configuration as the packaging kit 100 according to the first embodiment, and the description of the same configuration has been omitted.

As illustrated in FIG. 11, in the fourth embodiment, the protrusion edge 142 of each tongue piece 140 protrudes inside the placement surface 120 and a corresponding standing side 130.

As illustrated in FIG. 12, also in the present embodiment, in the same way as the first embodiment, the tongue piece 140 is bent in a V shape in side view (by about 90 degrees) with a standing side 130*b* bent so that the protrusion edge 142 corresponds to a vertex of the V shape in side view. It is therefore possible to prevent the standing side 130 in a standing position from easily restoring with cardboard restoring force. It is therefore possible to keep the standing side 130 in the standing position at an angle of about 90 degrees relative to the placement surface 120.

The protrusion edge 142 protrudes inside the standing side 130*b* with the standing side 130*b* raised.

A body section 144 is elongated from the placement surface 120. The body section 144 is located inside the standing side 130*b* with the standing side 130 raised. Length of the body section 144 is almost the same as length of a coupling section 146.

The coupling section 146 is continuous between the standing side 130*b* and the body section 144. The coupling section 146 is located inside the standing side 130*b* with the standing side 130 raised.

In the present embodiment, with the standing side 130 raised, all the body section 144 and the coupling section 146 are located inside the standing side 130*b*. That is, with the standing side 130 raised, all of a tongue piece 140*b* is located inside the standing side 130*b*. It is therefore possible to cause all of the tongue piece 140*b* to fix a target object 50 to be packaged. It is consequently possible to prevent the target object 50 from easily being shifted during transportation.

Figure 13A:
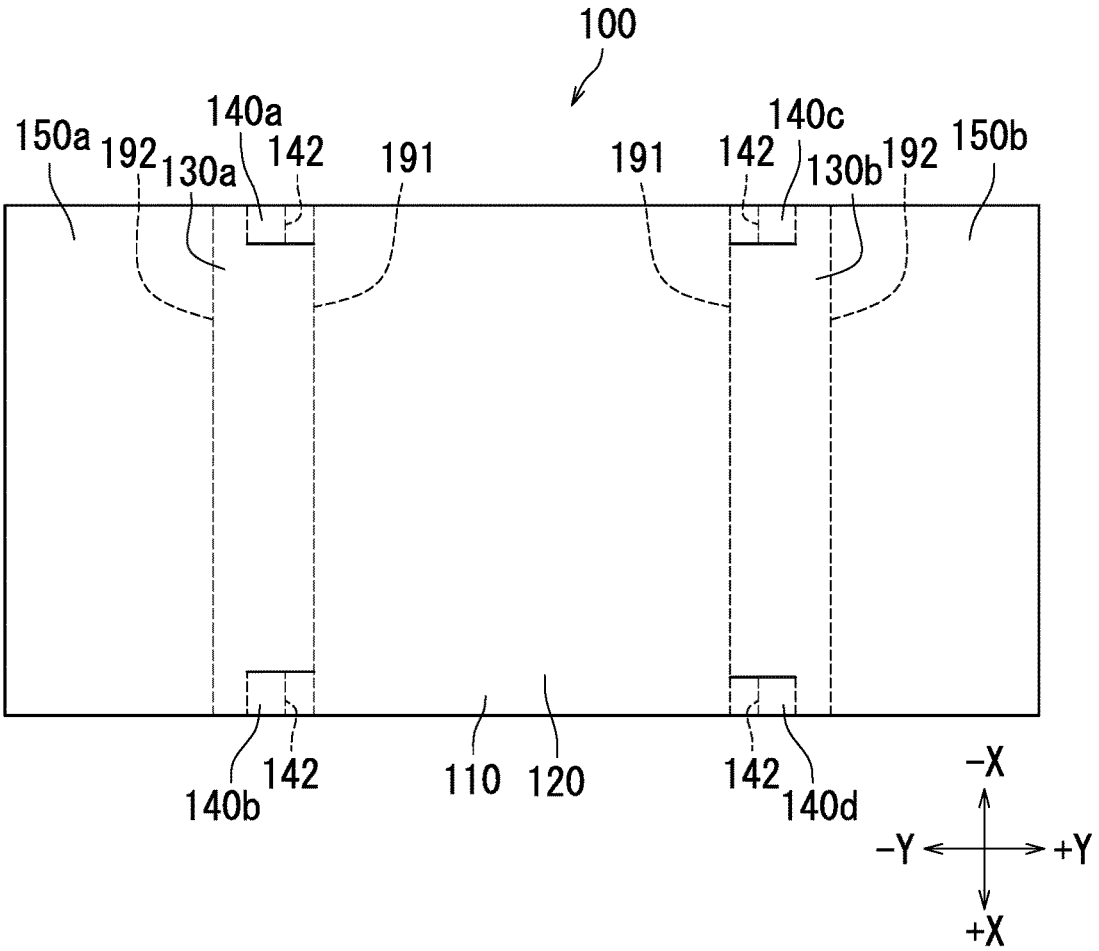
FIG. 13A is a development plan of the packaging kit according to the fourth embodiment of the present disclosure.
Figure 13B:
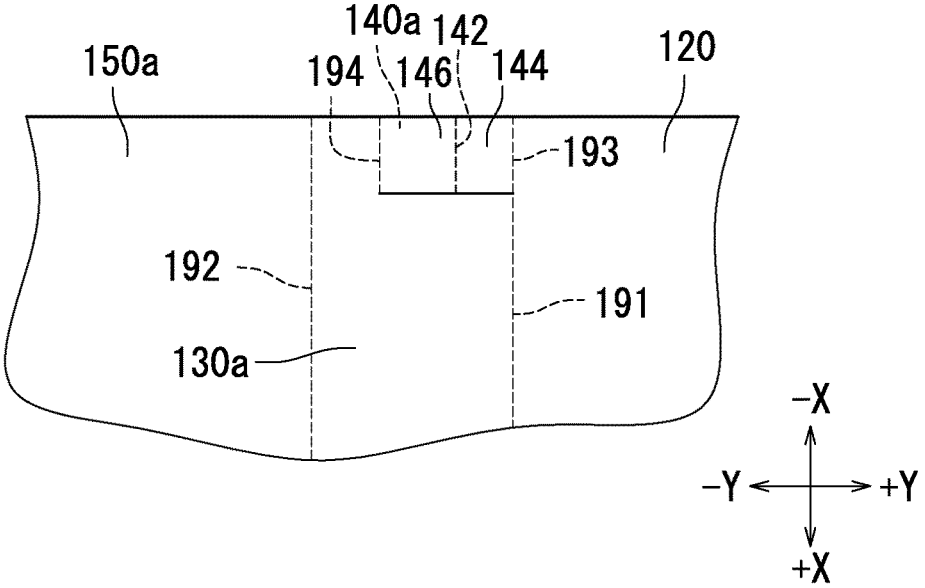
FIG. 13B is an enlarged view of an area adjacent to a tongue piece provided for the packaging kit according to the fourth embodiment of the present disclosure.

The packaging kit 100 according to the fourth embodiment of the present disclosure will further be described with reference to FIGS. 13A and 13B. FIG. 13A is a development plan of the packaging kit 100 according to the fourth embodiment of the present disclosure. FIG. 13B is an enlarged view of an area adjacent to a tongue piece 140*a* provided for the packaging kit 100 according to the fourth embodiment of the present disclosure.

As illustrated in FIGS. 13A and 13B, two fold lines 191, two fold lines 192, four fold lines 193, and four fold lines 194 are formed on a sheet member 110. The fold lines 191, the fold lines 192, the fold lines 193, and the fold lines 194 are elongated along an X-axial direction. The fold lines 191 allow a standing side 130*a* and the standing side 130*b* to be bent along the fold lines 191 relative to the placement surface 120. One of the fold lines 192 allows a top flap 150*a* to be bent along the fold line 192 relative to the standing side 130*a*. The other of the fold lines 192 allows a top flap 150*b* to be bent along the fold line 192 relative to the standing side 130*b*.

As illustrated in FIG. 13B, the body section 144 is rectangular. An end edge of the body section 144 in a Y-axis positive direction and the placement surface 120 are continuous across the fold line 193. The fold line 193 functions as a pivot to allow the body section 144 to be turned around the fold line 193 relative to the placement surface 120.

The coupling section 146 is rectangular. An end edge of the coupling section 146 on the side of a Y-axis negative direction, and the standing side 130 are continuous across the fold line 194. The fold line 194 functions as a pivot to allow the coupling section 146 to be turned around the fold line 194 relative to the standing side 130.

Figure 14:
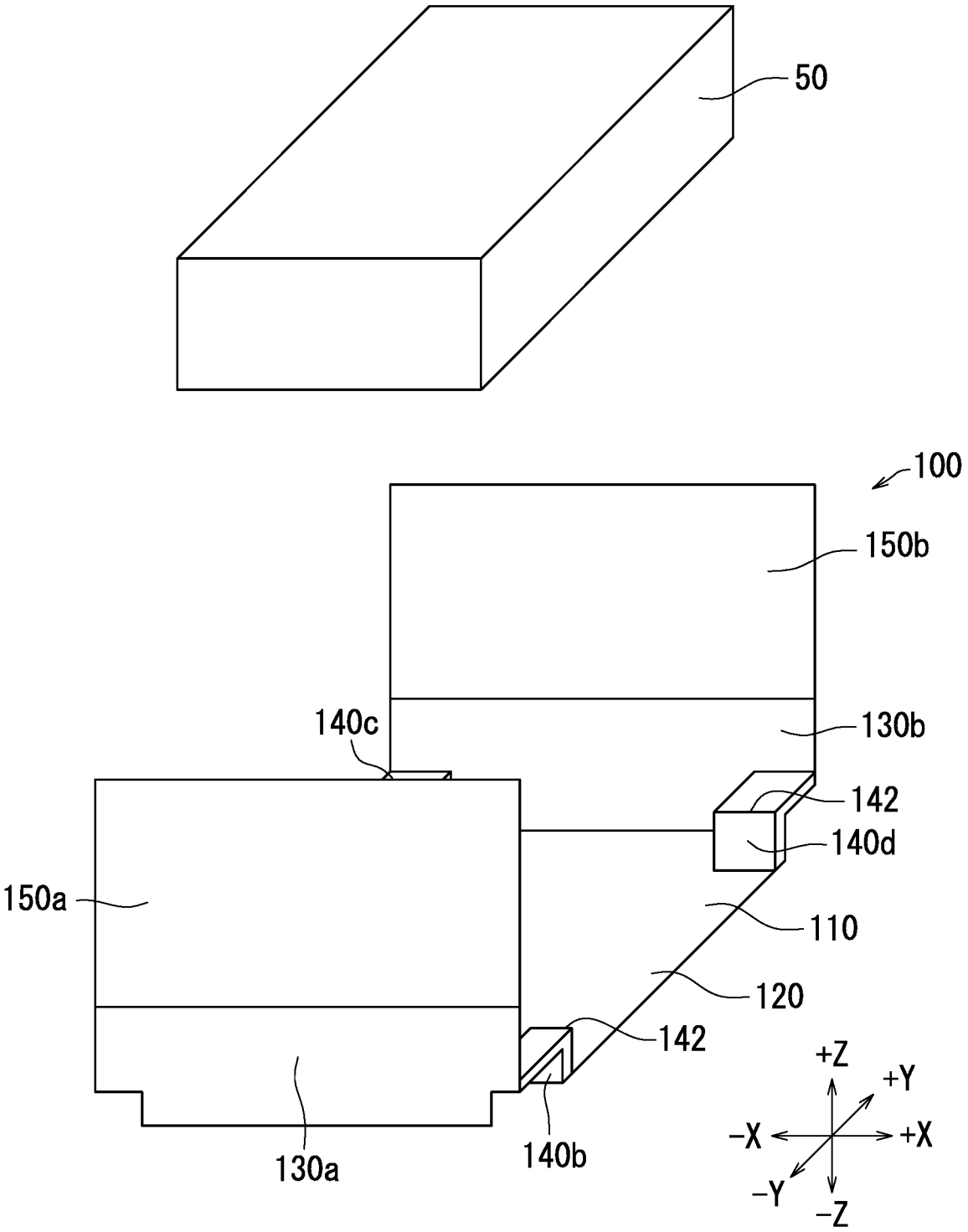
FIG. 14 is a perspective view illustrating a packaging method of a target object to be packaged using the packaging kit.
Figure 15A:
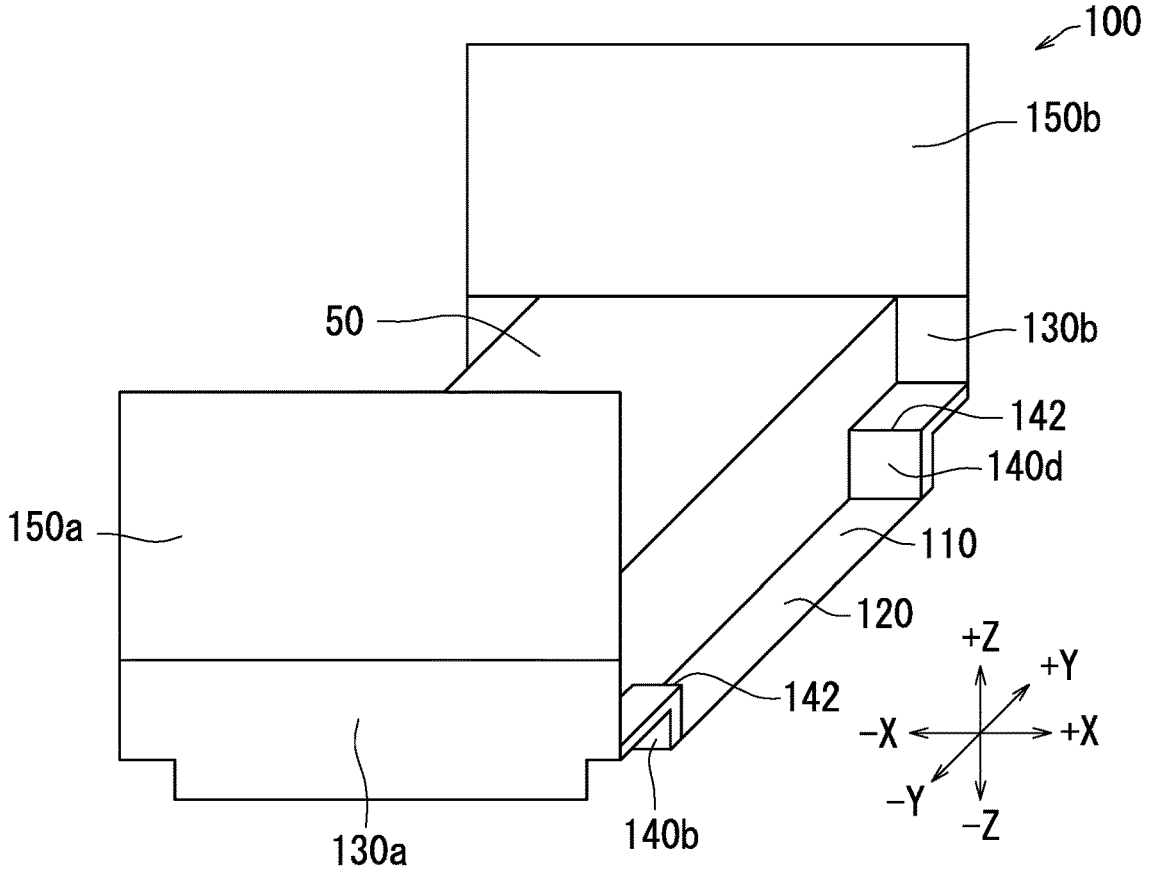
FIGS. 15A and 15B are perspective views illustrating the packaging method of the target object using the packaging kit.
Figure 15B:
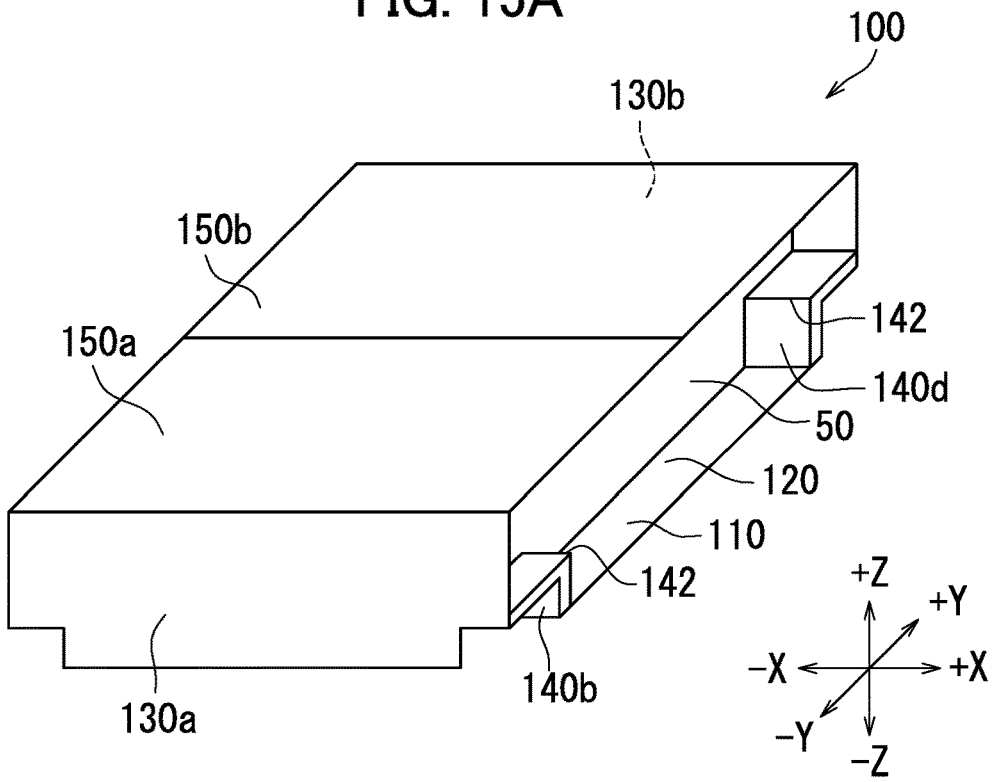

A packaging method of the target object 50 using the packaging kit 100 will be described with reference to FIGS. 14, 15A, and 15B. FIGS. 14, 15A, and 15B are perspective views illustrating the packaging method of the target object 50 using the packaging kit 100.

As illustrated in FIG. 14, the target object 50 is a target object to be packaged, which is rectangular cuboid. Width (length along the X-axial direction) of the target object 50 is shorter than a distance between the tongue piece 140*a* and the tongue piece 140*b*. Herein, the width of the target object 50 is slightly shorter than the distance between the tongue piece 140*a* and the tongue piece 140*b*. Length (length along a Y-axial direction) of the target object 50 is shorter than length of the placement surface 120 along the Y-axial direction. Herein, the length of the target object 50 is slightly shorter than the length of the placement surface 120 along the Y-axial direction.

The standing side 130*a* is bent towards a Z-axis positive direction so that the protrusion edge 142 of the tongue piece 140*a*, and the protrusion edge 142 of the tongue piece 140*b* protrude inside the standing side 130*a* and the placement surface 120. It is therefore possible to prevent the standing side 130*a* in a standing position from easily restoring with cardboard restoring force. It is consequently possible to keep the standing side 130*a* in the standing position at an angle of about 90 degrees relative to the placement surface 120.

Similarly, the standing side 130*b* is bent towards the Z-axis positive direction so that the protrusion edge 142 of a tongue piece 140*c* and the protrusion edge 142 of the tongue piece 140*d* protrude inside the standing side 130*b* and the placement surface 120. It is therefore possible to prevent the standing side 130*b* in a standing position from easily restoring with cardboard restoring force. It is consequently possible to keep the standing side 130*b* in the standing position at an angle of about 90 degrees relative to the placement surface 120.

As illustrated in FIG. 15A, the target object 50 is then placed on the placement surface 120. This enables easy placement of the target object 50 on the placement surface 120 because the standing side 130*a* and the standing side 130*b* are kept in the standing position at the angle of about 90 degrees relative to the placement surface 120.

As illustrated in FIG. 15B, the top flap 150*a* is then bent towards the Y-axis positive direction. The top flap 150*b* is also bent towards the Y-axis negative direction. The top flap 150*a* and the top flap 150*b* are joined with an adhesive tape. Each tongue piece 140 is located at the side of a side edge of a corresponding standing side 130, thereby enabling easy fixing of the target object 50. It is therefore possible to prevent the target object 50 from easily being shifted during transportation.

Fifth Embodiment

Figure 16:
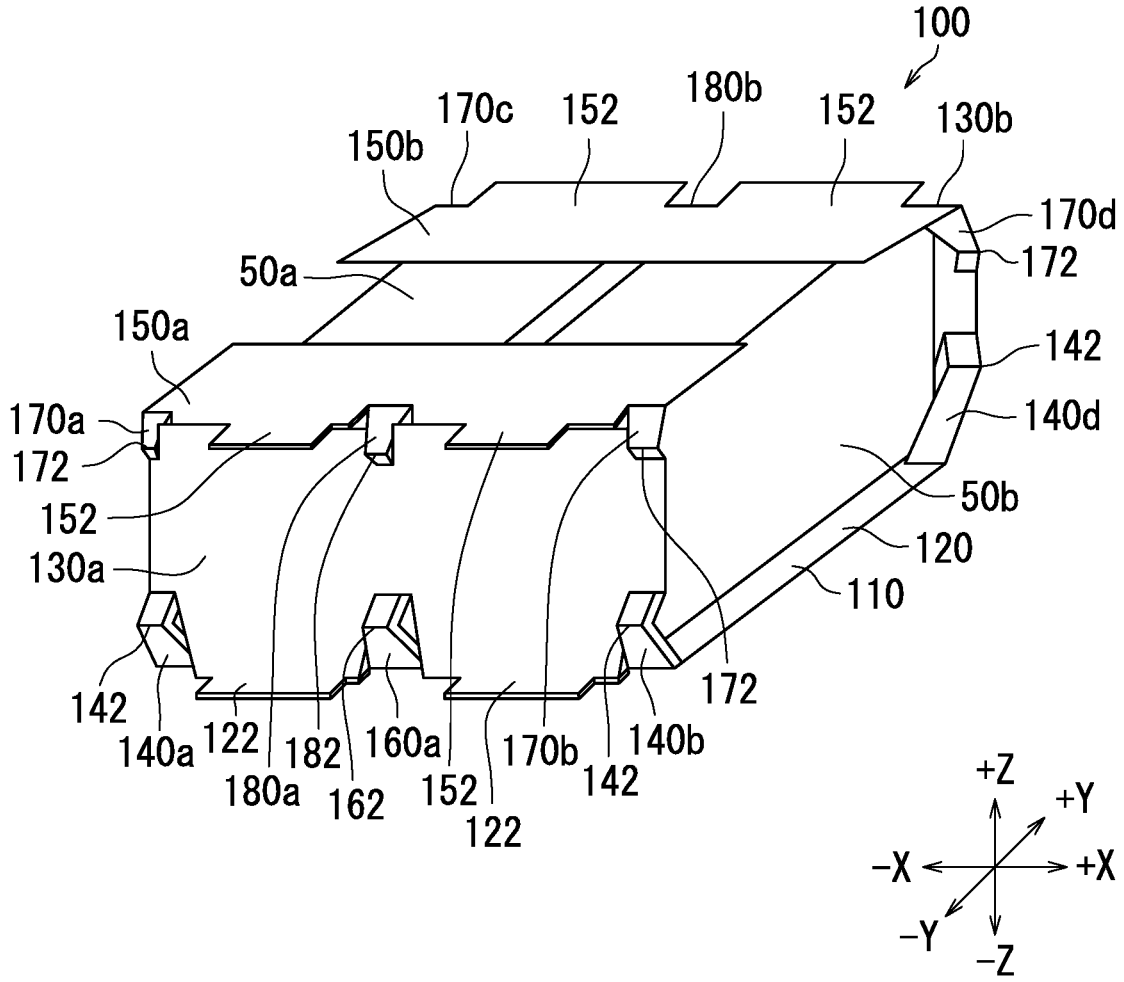
FIG. 16 is a schematic perspective view of a packaging kit according to a fifth embodiment of the present disclosure.

A packaging kit 100 according to a fifth embodiment of the present disclosure will be described with reference to FIG. 16. FIG. 16 is a schematic perspective view of the packaging kit 100 according to the fifth embodiment of the present disclosure. Each packaging kit 100 according to the first to fourth embodiments allows one target object 50 to be packaged, whereas the present embodiment allows two target objects 50 to be packaged. The description about identical constituent elements to those of each packaging kit 100 according to the first to fourth embodiments has been omitted.

As illustrated in FIG. 16, the packaging kit 100 includes a sheet member 110. The packaging kit 100 allows packaging of a target object 50 to be packaged. In the present embodiment, the packaging kit 100 allows packaging of two target objects 50. The sheet member 110 allows the target objects 50 to be placed thereon. The packaging kit 100 is used with the packaging kit 100 put in an outer case having a rectangular cuboid shape.

The sheet member 110 allows the target objects 50 to be placed thereon. The sheet member 110 includes two center tongue pieces (a center tongue piece 160*a* and a center tongue piece 160*b*), four second tongue pieces (a second tongue piece 170*a*, a second tongue piece 170*b*, a second tongue piece 170*c*, and a second tongue piece 170*d*), two second center tongue pieces (a second center tongue piece 180*a* and a second center tongue piece 180*b*), four protrusions 122, and four protrusions 152, besides a placement surface 120, two standing sides (a standing side 130*a* and a standing side 130*b*), four tongue pieces (a tongue piece 140*a*, a tongue piece 140*b*, a tongue piece 140*c*, and a tongue piece 140*d*), and a top flap (a top flap 150*a* and a top flap 150*b*).

In the present specification, the center tongue piece 160*a* and the center tongue piece 160*b* may also collectively be referred to as center tongue pieces 160. In the present specification, the second tongue piece 170*a*, the second tongue piece 170*b*, the second tongue piece 170*c*, and the second tongue piece 170*d* may also collectively be referred to as second tongue pieces 170. The second center tongue piece 180*a* and the second center tongue piece 180*b* may also collectively be referred to as second center tongue pieces 180.

The placement surface 120 and standing sides 130 are provided with the center tongue pieces 160. Specifically, the placement surface 120 and the standing side 130*a* are provided with the center tongue piece 160*a*. The placement surface 120 and the standing side 130*b* are provided with the center tongue piece 160*b*. Each center tongue piece 160 is located closer to the center of a corresponding standing side 130 than corresponding two tongue pieces 140. Specifically, the center tongue piece 160*a* is located closer to the center of the standing side 130*a* than the tongue piece 140*a* and the tongue piece 140*b*. In the present embodiment, the center tongue piece 160*a* is located at the center between the tongue piece 140*a* and the tongue piece 140*b*. That is, a distance between the tongue piece 140*a* and the center tongue piece 160*a* is equal to a distance between the tongue piece 140*b* and the center tongue piece 160*a*. Similarly, the center tongue piece 160*b* is located closer to the center of the standing side 130*b* than the tongue piece 140*c* and the tongue piece 140*d*. In the present embodiment, the center tongue piece 160*b* is located at the center between the tongue piece 140*c* and the tongue piece 140*d*. That is, a distance between the tongue piece 140*c* and the center tongue piece 160*b* is equal to a distance between the tongue piece 140*d* and the center tongue piece 160*b*.

Each center tongue piece 160 has a center protrusion edge 162. Each center protrusion edge 162 protrudes outside a corresponding standing side 130 with the corresponding standing side 130 raised.

The tongue pieces 140 and the center tongue pieces 160 enable easy fixing of the target object 50. Specifically, the tongue piece 140*a*, the center tongue piece 160*a*, the tongue piece 140*c*, and the center tongue piece 160*b* enable fixing of a target object 50*a*. The tongue piece 140*b*, the center tongue piece 160*a*, the tongue piece 140*d*, and the center tongue piece 160*b* enable fixing of a target object 50*b*.

Each top flap 150 and a corresponding standing side 130 are provided with two second tongue pieces 170. Specifically, the top flap 150*a* and the standing side 130*a* are provided with the second tongue piece 170*a* and the second tongue piece 170*b*. The top flap 150*b* and the standing side 130*b* are provided with the second tongue piece 170*c* and the second tongue piece 170*d*. The packaging kit 100 is provided with the second tongue piece 170 located on a side of at least one side edge of each standing side 130. Specifically, the second tongue piece 170*a* and the second tongue piece 170*b* are located at respective sides of both side edges of the standing side 130*a*. The second tongue piece 170*c* and the second tongue piece 170*d* are located at respective sides of both side edges of the standing side 130*b*. Each second tongue piece 170 is in contact with a side edge of a corresponding standing side 130. Specifically, the second tongue piece 170*a* and the second tongue piece 170*b* are in contact with the respective sides of both the side edges of the standing side 130*a*. The second tongue piece 170*c* and the second tongue piece 170*d* are in contact with the respective sides of both the side edges of the standing side 130*b*. Each of the second tongue pieces 170*a* to 170*d* has a protrusion edge 172.

Each top flap 150 and a corresponding standing side 130 are provided with the second center tongue piece 180. Specifically, the top flap 150*a* and the standing side 130*a* are provided with the second center tongue piece 180*a*. The top flap 150*b* and the standing side 130*b* are provided with the second center tongue piece 180*b*. Each second center tongue piece 180 is located closer to the center of a corresponding standing side 130 than corresponding two second tongue pieces 170. Specifically, the second center tongue piece 180*a* is located closer to the center of the standing side 130*a* than the second tongue piece 170*a* and the second tongue piece 170*b*. In the present embodiment, the second center tongue piece 180*a* is located at the center between the second tongue piece 170*a* and the second tongue piece 170*b*. That is, a distance between the second tongue piece 170*a* and the second center tongue piece 180*a* is equal to a distance between the second tongue piece 170*b* and the second center tongue piece 180*a*. Similarly, the second center tongue piece 180*b* is located closer to the center of the standing side 130*b* than the second tongue piece 170*c* and the second tongue piece 170*d*. In the present embodiment, the second center tongue piece 180*b* is located at the center between the second tongue piece 170*c* and the second tongue piece 170*d*. That is, a distance between the second tongue piece 170*c* and the second center tongue piece 180*b* is equal to a distance between the second tongue piece 170*d* and the second center tongue piece 180*b*. Each of the second center tongue piece 180*a* and the second center tongue piece 180*b* has a center protrusion edge 182.

The second tongue pieces 170 and the second center tongue pieces 180 enable fixing of the target object 50. Specifically, the second tongue piece 170*a*, the second center tongue piece 180*a*, the second tongue piece 170*c*, and the second center tongue piece 180*b* enable fixing of the target object 50*a*. The second tongue piece 170*b* the second center tongue piece 180*a*, the second tongue piece 170*d*, and the second center tongue piece 180*b* also enable fixing of the target object 50*b*.

The protrusion edges 142 of the tongue pieces 140, the center protrusion edges 162 of the center tongue pieces 160, the protrusion edges 172 of the second tongue pieces 170, and the center protrusion edges 182 of the second center tongue pieces 180 protrude outside the standing sides 130. A buffering effect is therefore obtained, with the packaging kit 100 put in the outer case, by the protrusion edges 142 of the tongue pieces 140, the center protrusion edges 162 of the center tongue pieces 160, the protrusion edges 172 of the second tongue pieces 170, and the center protrusion edges 182 of the second center tongue pieces 180.

The protrusions 122 are elongated from the placement surface 120. Two protrusion 122 protrudes outside a corresponding standing side 130 from an end of the corresponding standing side 130. A buffering effect is therefore obtained by the protrusions 122 with the packaging kit 100 put in the outer case.

Two protrusions 152 are elongated from a corresponding top flap 150. Two protrusions 152 protrudes outside a corresponding standing side 130 from an end of the corresponding standing side 130. A buffering effect is therefore obtained by the protrusions 152 with the packaging kit 100 put in the outer case.

Figure 17:
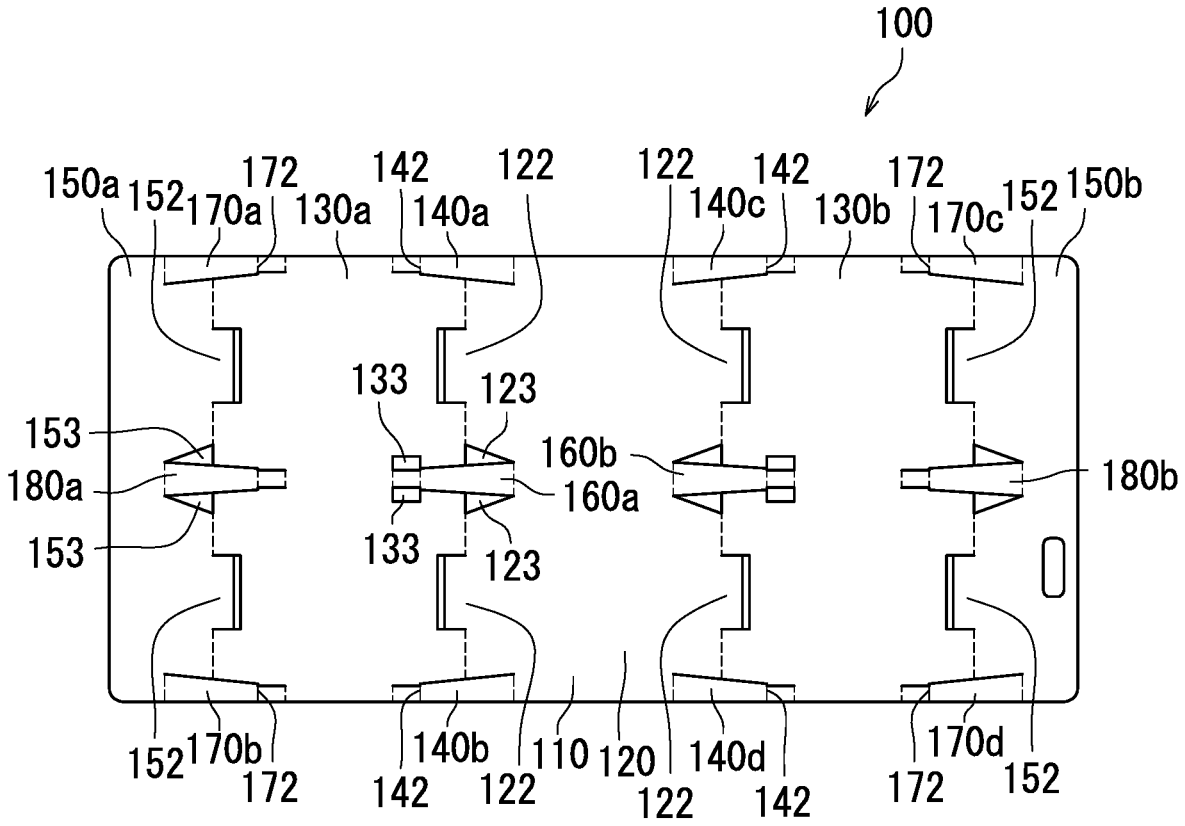
FIG. 17 is a development plan of the packaging kit according to the fifth embodiment of the present disclosure.

The packaging kit 100 according to the fifth embodiment of the present disclosure will further be described with reference to FIG. 17. FIG. 17 is a development plan of the packaging kit 100 according to the fifth embodiment of the present disclosure.

As illustrated in FIG. 17, the placement surface 120 is provided with four openings 123. In the present embodiment, each of the openings 123 is triangular. Each of the openings 123 is located in an area of the placement surface 120 adjacent to a corresponding center tongue piece 160. Therefore, when the standing sides 130 are raised, friction generated between the standing sides 130 and the center tongue pieces 160 is reduced, thereby facilitating raising of the standing sides 130. Furthermore, it is possible to prevent the center tongue pieces 160 from easily being bent into an unexpected shape due to the influence of the standing sides 130 being bent when the standing sides 130 are raised.

Each standing side 130 is provided with two openings 133. In the present embodiment, each opening 133 is triangular. Each opening 133 is located in an area of a corresponding standing side 130 adjacent to a corresponding center tongue piece 160. Therefore, when the standing sides 130 are raised, friction generated between the standing sides 130 and the center tongue pieces 160 is reduced, thereby facilitating raising of the standing sides 130. Furthermore, it is possible to prevent the center tongue pieces 160 from easily being bent into an unexpected shape due to the influence of the standing sides 130 being bent when the standing sides 130 are raised.

Each top flap 150 is provided with two openings 153. In the present embodiment, each opening 153 is triangular. Each opening 153 is located in an area of a corresponding top flap 150 adjacent to a corresponding second center tongue piece 180. Therefore, when the top flaps 150 are bent, friction generated between the top flaps 150 and the second center tongue pieces 180 is reduced, thereby facilitating bending of the top flaps 150. Furthermore, it is possible to prevent the second center tongue pieces 180 from easily being bent into an unexpected shape due to the influence of the top flaps 150 being bent when the top flaps 150 are bent.

Figure 18:
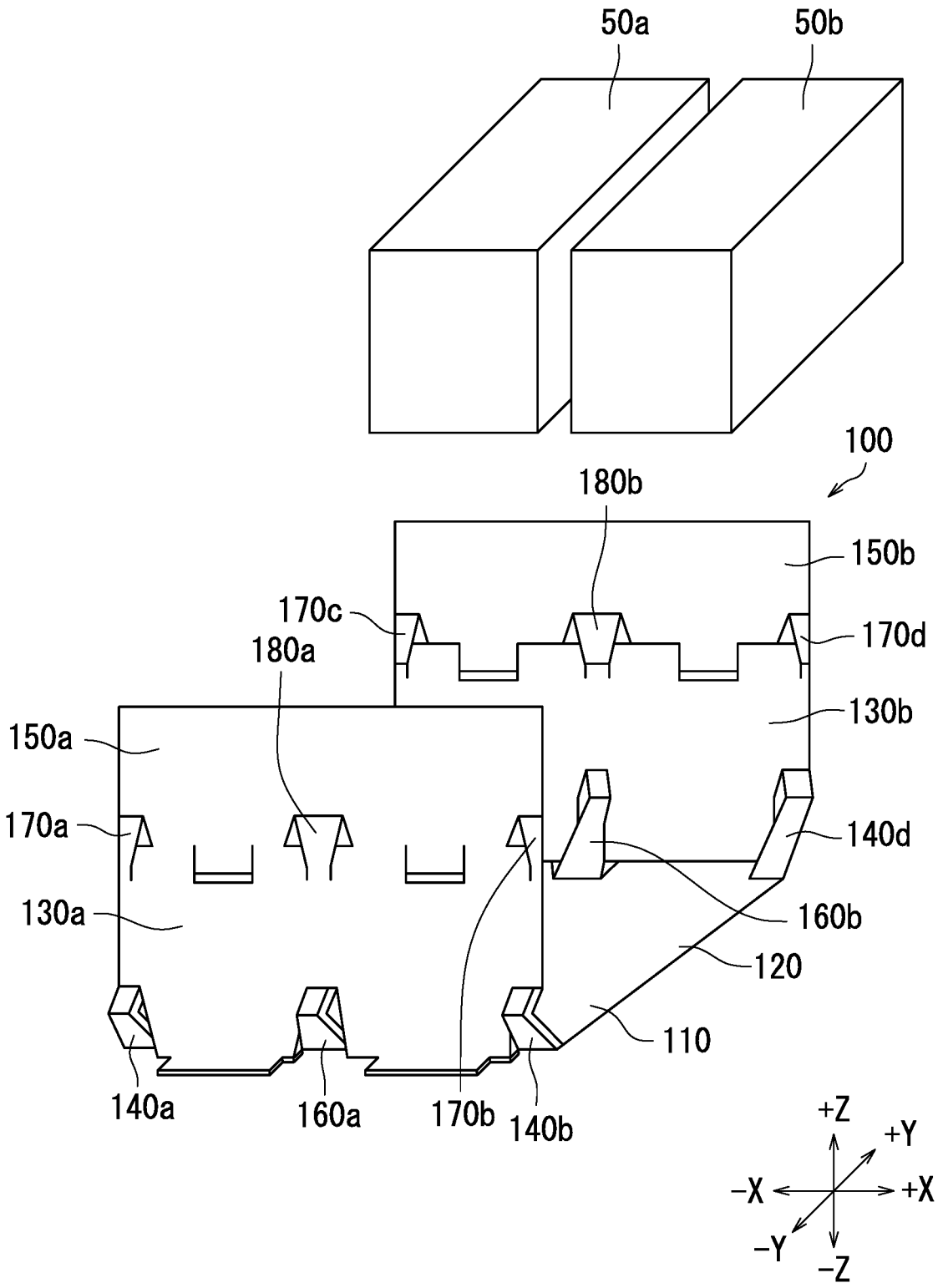
FIG. 18 is a perspective view illustrating a packaging method of target objects to be packaged using the packaging kit.
Figure 19A:
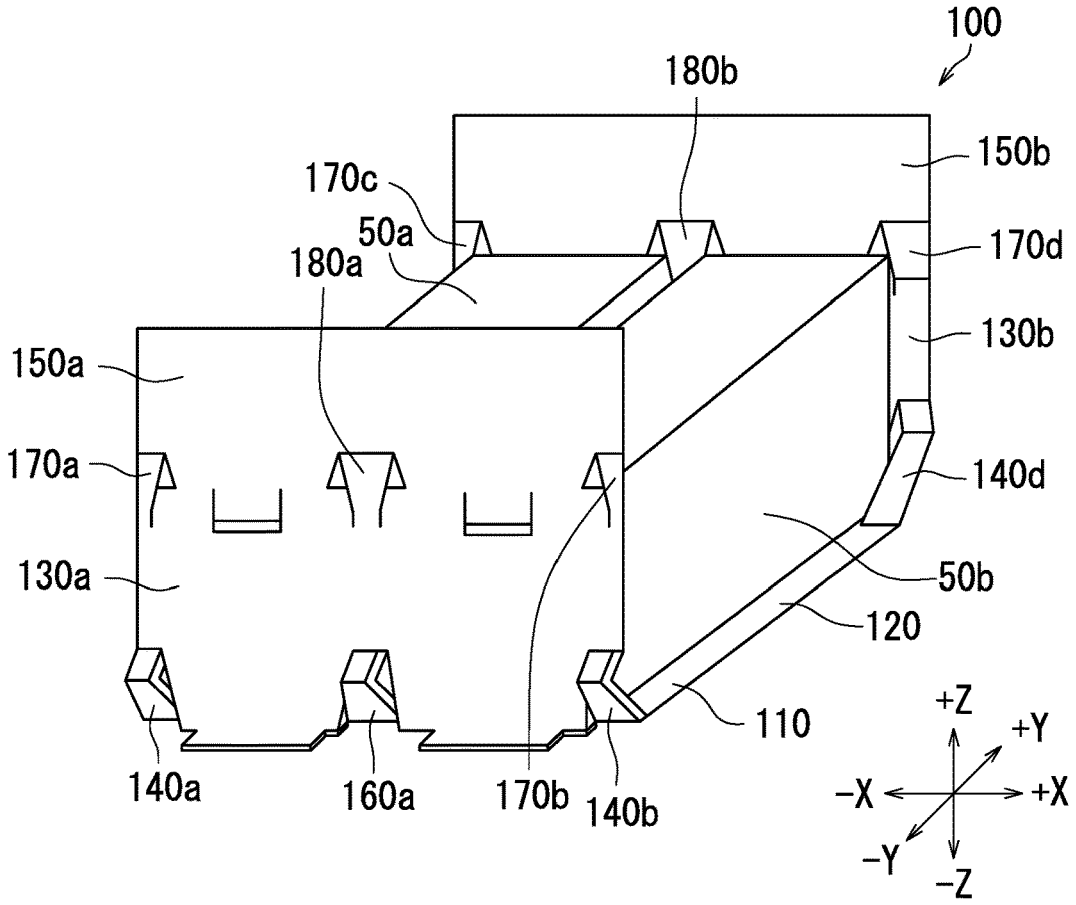
FIGS. 19A and 19B are perspective views illustrating the packaging method of the target objects using the packaging kit.
Figure 19B:
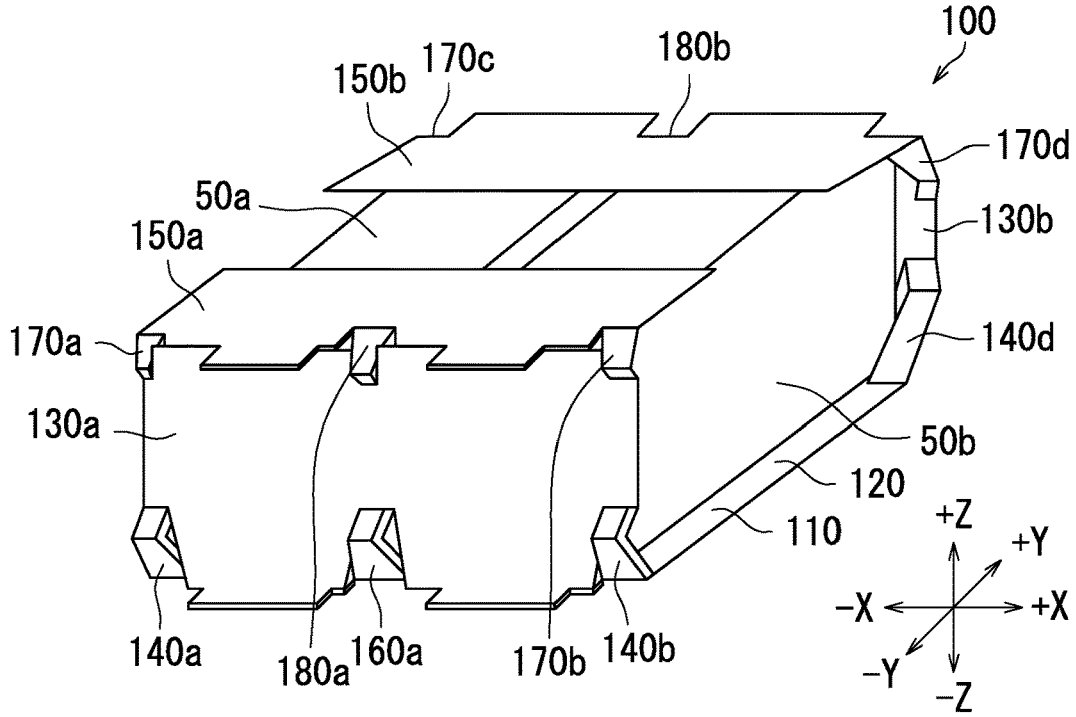

A packaging method of the target object 50 using the packaging kit 100 will be described with reference to FIGS. 18, 19A, and 19B. FIGS. 18, 19A, and 19B are perspective views illustrating the packaging method of the target object 50 using the packaging kit 100.

As illustrated in FIG. 18, each of the target objects 50*a* and 50*b* is a target object to be packaged, which is rectangular cuboid. Width (length along an X-axial direction) of the target object 50*a* is shorter than a distance between the tongue piece 140*a* and the center tongue piece 160*a*. Herein, the width of the target object 50*a* is slightly shorter than the distance between the tongue piece 140*a* and the center tongue piece 160*a*. Length (length along a Y-axial direction) of the target object 50*a* is shorter than length of the placement surface 120 along the Y-axial direction. Herein, the length of the target object 50*a* is slightly shorter than the length of the placement surface 120 along the Y-axial direction. Width (length along the X-axial direction) of the target object 50*b* is shorter than a distance between the tongue piece 140*b* and the center tongue piece 160*a*. Herein, the width of the target object 50*b* is slightly shorter than the distance between the tongue piece 140*b* and the center tongue piece 160*a*. Length (length along the Y-axial direction) of the target object 50*b* is shorter than the length of the placement surface 120 along the Y-axial direction. Herein, the length of the target object 50*b* is slightly shorter than the length of the placement surface 120 along the Y-axial direction.

The standing side 130*a* and the standing side 130*b* are first bent towards a Z-axis positive direction. Bending the standing side 130*a* in the Z-axis positive direction enables the tongue piece 140*a*, the tongue piece 140*b*, and the center tongue piece 160*a* to be engaged with the standing side 130*a*. It is therefore possible to prevent the standing side 130*a* in a standing position from easily restoring with cardboard restoring force. It is consequently possible to keep the standing side 130*a* in the standing position at an angle of about 90 degrees relative to the placement surface 120.

Similarly, bending the standing side 130*b* in the Z-axis positive direction enables the tongue piece 140*c*, the tongue piece 140*d*, and the center tongue piece 160*b* to be engaged with the standing side 130*b*. It is therefore possible to prevent the standing side 130*b* in a standing position from easily restoring with cardboard restoring force. It is consequently possible to keep the standing side 130*b* in the standing position at an angle of about 90 degrees relative to the placement surface 120.

As illustrated in FIG. 19A, the target objects 50*a* and 50*b* are placed on the placement surface 120. The standing side 130*a* and the standing side 130*b* being kept in the standing position at the angle of about 90 degrees relative to the placement surface 120 enables easy placement of the target objects 50*a* and 50*b* on the placement surface 120.

As illustrated in FIG. 19B, the top flap 150*a* is then bent towards a Y-axis positive direction. The top flap 150*b* is also bent towards a Y-axis negative direction. The packaging kit 100 is put in the external case having the rectangular cuboid shape, so that the packaging is complete. The tongue piece 140*a*, the center tongue piece 160*a*, the tongue piece 140*c*, and the center tongue piece 160*b* fix a lower end of the target object 50*a*. The second tongue piece 170*a*, the second center tongue piece 180*a*, the second tongue piece 170*c*, and the second center tongue piece 180*b* also fix an upper end of the target object 50*a*. It is therefore possible to prevent the target object 50*a* from easily being shifted during transportation. Similarly, the tongue piece 140*b*, the center tongue piece 160*a*, the tongue piece 140*d*, and the center tongue piece 160*b* fix a lower end of the target object 50*b*. The second tongue piece 170*b* the second center tongue piece 180*a*, the second tongue piece 170*d* and the second center tongue piece 180*b* also fix an upper end of the target object 50*b*. It is therefore possible to prevent the target object 50*b* from easily being shifted during transportation.

Sixth Embodiment

Figure 20:
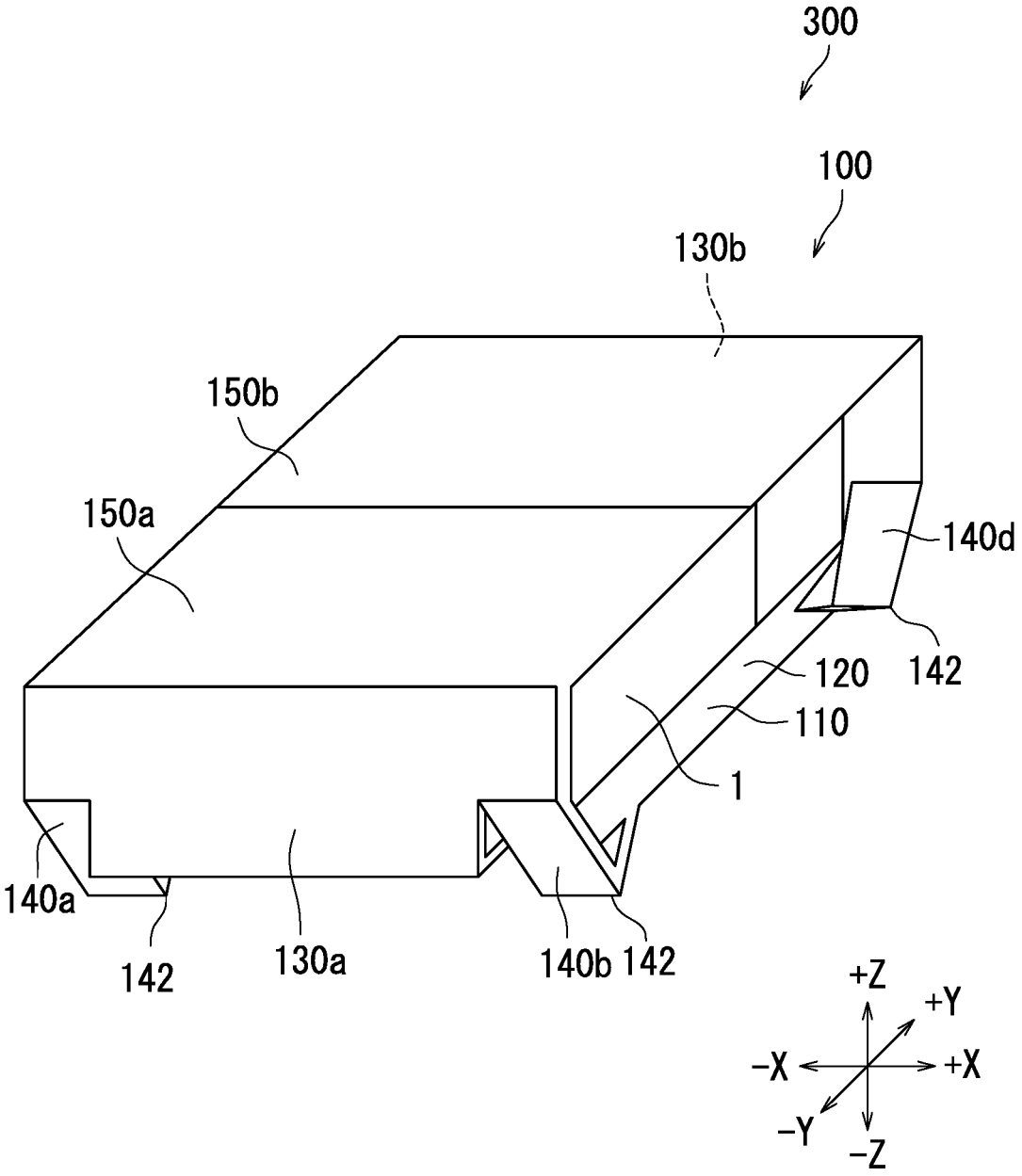
FIG. 20 is a schematic perspective view of a packaging set according to a sixth embodiment of the present disclosure.

A packaging set 300 according to a sixth embodiment of the present disclosure will be described with reference to FIG. 20. FIG. 20 is a schematic perspective view of the packaging set 300 according to the sixth embodiment of the present disclosure.

As illustrated in FIG. 20, the packaging set 300 includes a packaging kit 100, and a holder 1.

The structure of the packaging kit 100 is the same as that of the packaging kit 100 according to the third embodiment, and therefore the description thereof has been omitted.

A placement surface 120 allows the holder 1 to be placed thereon. The holder 1 is allowed to hold a target object 50.

Figure 21:
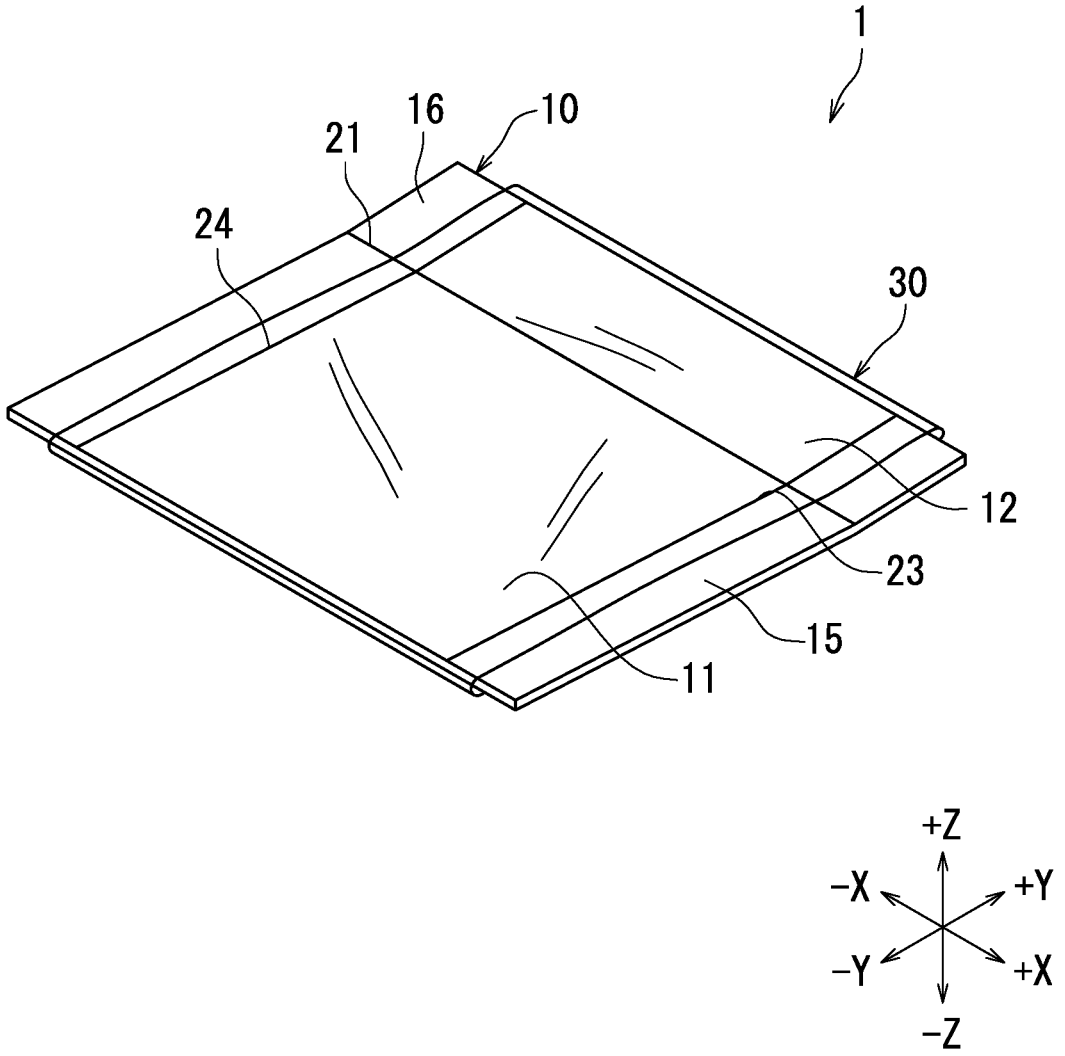
FIG. 21 is a perspective view of a holder according to the sixth embodiment of the present disclosure.

The holder 1 will be described with reference to FIGS. 21 to 24. FIG. 21 is a perspective view of the packaging kit 100 according to the sixth embodiment of the present disclosure. As illustrated in FIG. 21, the holder 1 includes a board 10, and a film 30. The board 10 exemplifies a holder sheet member. In the present embodiment, the film 30 is tubular. The film 30 is attached to the board 10. Specifically, the board 10 is wound by the film 30. The holder 1 allows packaging of the target object 50.

In the present embodiment, the board 10 is made of, for example a single sheet of cardboard that is about 5 millimeters in thickness. The film 30 is, for example an extendable (flexible) film made of polyethylene. The film 30 is colorless and transparent, but not limited to this. The film 30 may be so-called translucent or opaque, or may be colored.

Note that FIG. 21 illustrates a leveled state of the holder 1. Dimensions of the holder 1 in the leveled state are, for example, about 300 millimeters in a left-right direction, and about 180 millimeters in a front-back direction. The dimensions of the holder 1 are not limited thereto. The dimensions are set according to the size or intended use of the target object to be packaged.

As illustrated in FIG. 21, the board 10 is provide with three fold lines (crease; score) 21, 23, and 24. That is, one main fold line 21, and two subsidiary fold lines 23 and 24 are formed. The fold lines 21, 23, and 24 are formed by so-called a creasing roller or creasing blade. The fold lines 21, 23, and 24 may be formed by perforation work.

The main fold line 21 is disposed at approximately the center position of the board 10 in the front-back direction to be parallel to the left-right direction (parallel to an X-axial direction). The main fold line 21 allows font and back ends of the board 10 to easily be displaced above and bent.

The subsidiary fold line 23 is disposed adjacent to a right end of the board 10 to be parallel to the front-back direction (parallel to a Y-axial direction). The subsidiary fold line 24 is disposed adjacent to a left end of the board 10 to be parallel to the front-back direction. The subsidiary fold line 23 allows the right end to easily be displaced above and bent. The subsidiary fold line 24 allows a left end of the board 10 to easily be displaced above and bent.

The board 10 is provided with four divisions—namely, a displacement surface 11 that allows placement, thereon, of the target object 50 to be packaged (FIG. 22), an adjacent surface 12 that is adjacent to the displacement surface 11, and two raised sections 15 and 16.

The main fold line 21 is disposed between the displacement surface 11 and the adjacent surface 12. In other words, the displacement surface 11 and the adjacent surface 12 are divided by the main fold line 21. The displacement surface 11 is located at a front side of the board 10, while the adjacent surface 12 is located at a back side of the board 10. The raised section 15 is partitioned so that the raised section 15 is adjacent to the displacement surface 11 and the adjacent surface 12 via the subsidiary fold line 23, while the raised section 16 is partitioned so that the raised section 16 is adjacent to the displacement surface 11 and the adjacent surface 12 via the subsidiary fold line 24. The raised section 15 is part of the board 10, which is on a right side of the subsidiary fold line 23. The raised section 16 is part of the board 10, which is on a left side of the subsidiary fold line 24. In other words, the displacement surface 11 is part of the board 10, which is on a front side of the main fold line 21 and is between the subsidiary fold lines 23 and 24. The adjacent surface 12 is part of the board 10, which is on a back side of the main fold line 21 and is between the subsidiary fold lines 23 and 24.

The main fold line 21 allows the adjacent surface 12 and back parts of the raised sections 15 and 16 to be bent relative to the displacement surface 11 and front parts of the raised sections 15 and 16.

The film 30 is disposed to mainly surround the displacement surface 11 and the adjacent surface 12. The tubular film 30 is disposed so that a width direction (a direction perpendicular to a peripheral direction) of the film 30 corresponds to the left-right direction. In other words, the film 30 is wound around the board 10 with the main fold line 21 put through a tube formed by the film 30.

The film 30 may be attached to the board 10 by various methods. For example, the film 30 may be attached to the board 10 with the board 10 put through the film 30 shaped like a ring in advance. For example, the film 30 may also be attached to the board 10 as a result of the film 30 being wound around the board 10 at least one turn to be adhered by a wrapping packaging machine or the like. The fold lines 21, 23, and 24 allow the board 10 to be bent with the film 30 attached to the board 10.

In the present embodiment, the main fold line 21 is offset behind the center of the board 10 in the front-back direction. That is, the main fold line 21 is disposed at a position deviated from the center of the board 10. An area of the displacement surface 11 is larger than an area of the adjacent surface 12.

Figure 22A:
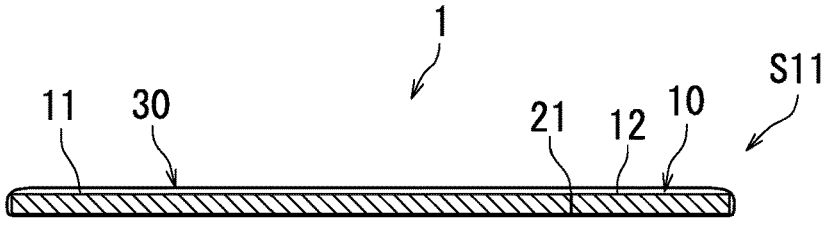
FIG. 22A to 22C illustrate longitudinal sections of the holder.
Figure 22B:
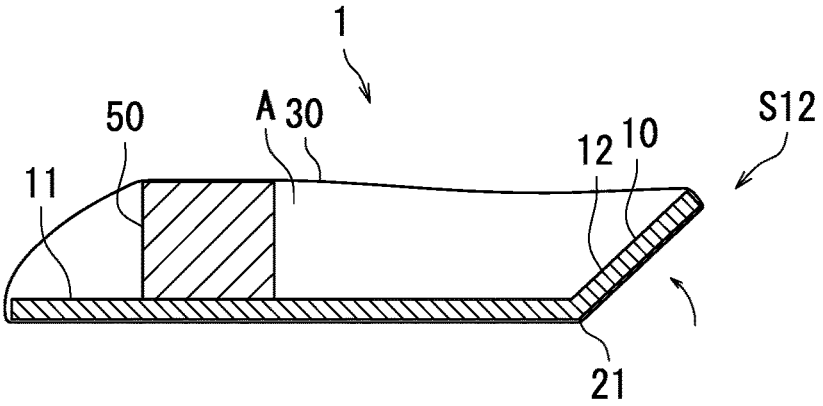
Figure 22C:
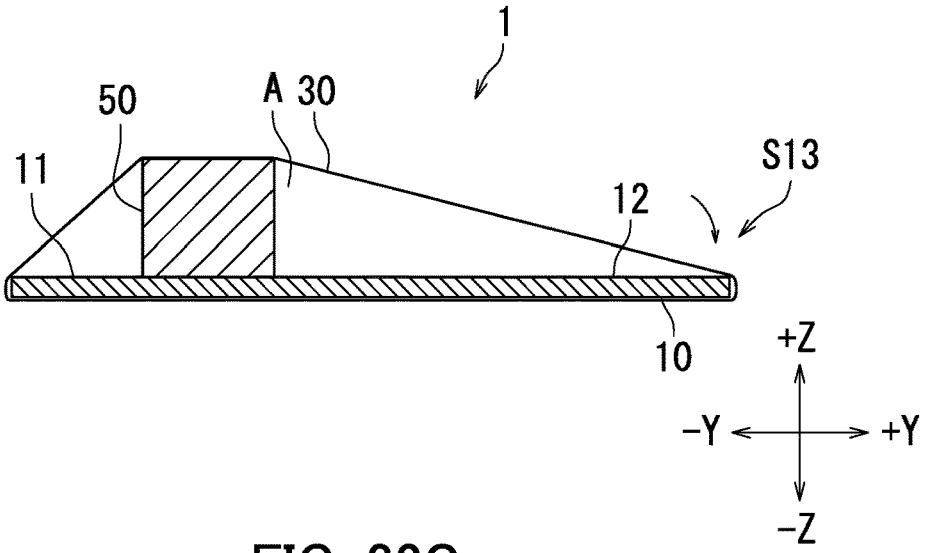

A packaging method of the target object 50 using the holder 1 will next be described. Each of FIGS. 22A to 22C depicts a longitudinal section of the holder 1. The packaging using the holder 1 is performed according to the order of steps S11, S12, and S13 illustrated from top to bottom of FIG. 22A to 22C.

As illustrated in FIG. 22A, the holder 1 has a flat sheet shape in the leveled state (S11). The board 10 is bent from this state (bending step). That is, as depicted by an up arrow in FIG. 22B, the board 10 is bent along the main fold line 21 so that the adjacent surface 12 approaches the displacement surface 11.

With the board 10 bent, the target object 50 is displaced in a hollow space A between the displacement surface 11 and the film 30 (S12; displacement step). Thus, the adjacent surface 12 is bent along the main fold line 21 relative to the displacement surface 11, so that the holder 1 is brought into a bent state (hereinafter also referred to as a "bent state"). The holder 1 in the bent state allows the target object to be placed in the hollow space A between the film 30 and the upper surface of the board 10.

As depicted by a down arrow in FIG. 22C, the adjacent surface 12 is then leveled relative to the displacement surface 11, so that the holder 1 is brought into a leveled state (S13). The film 30 is consequently stretched while being in contact with an upper part of the target object 50. Thus, the target object 50 is pressed on the board 10 (leveling step).

Figure 23:
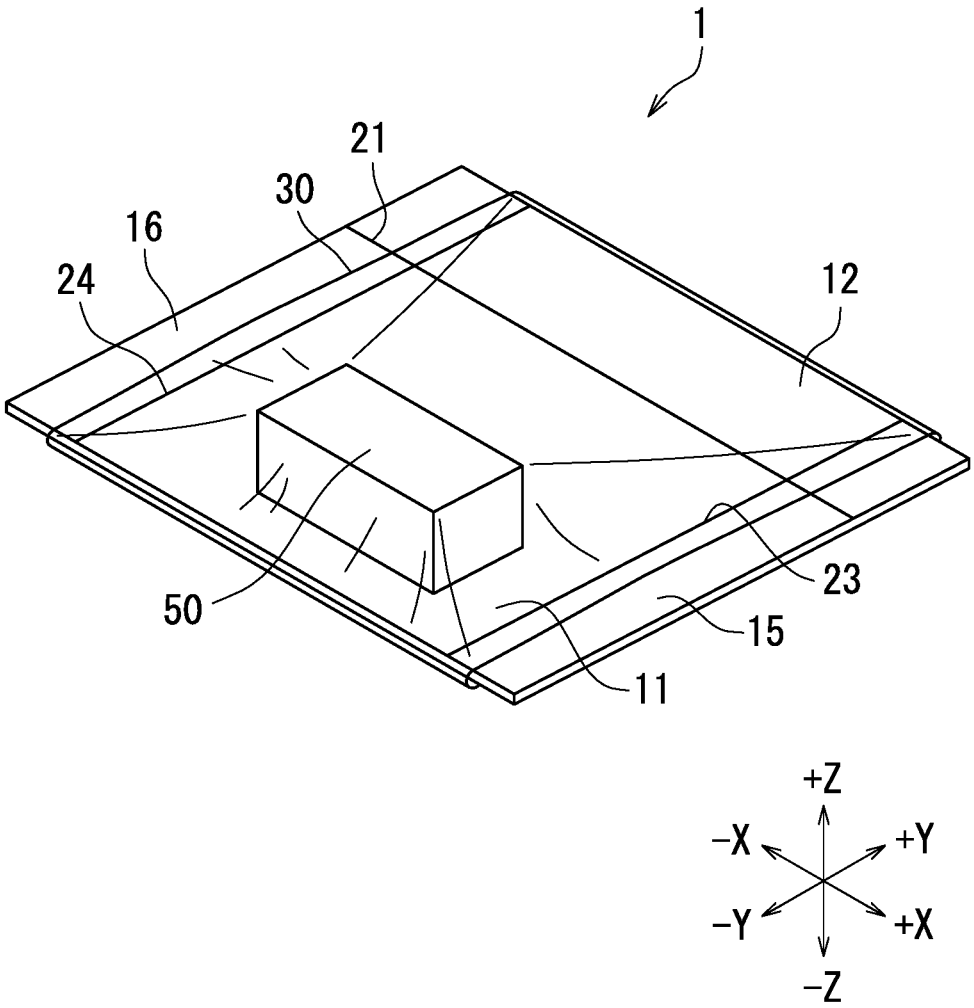
FIG. 23 is a perspective view of the holder that is packaged and brought into the leveled state.

FIG. 23 is a perspective view of the holder 1 that is packaged and brought into the leveled state.

As illustrated in FIG. 23, as a result of the target object 50 being placed, path length after the leveling step becomes longer than path length in an original leveled state. Herein, the path length is the length of a path, in side view, connecting a front end and a back end of the board 10, the main fold line 21, and the upper part of the target object 50 with straight lines. The film 30 is slightly extended and stretched while being in contact with the upper part of the target object 50. The film 30 therefore presses the target object 50 on the board 10.

Here, in the present embodiment, the raised sections 15 and 16 are bent along the subsidiary fold lines 23 and 24 relative to the displacement surface 11 at the abovementioned leveling step, and thereby become in a raised state. Thus, leveling the adjacent surface 12 relative to the displacement surface 11 enables stretching of the film 30. Note that the raised sections 15 and 16 may be raised after the leveling step (raising step).

Figure 24:
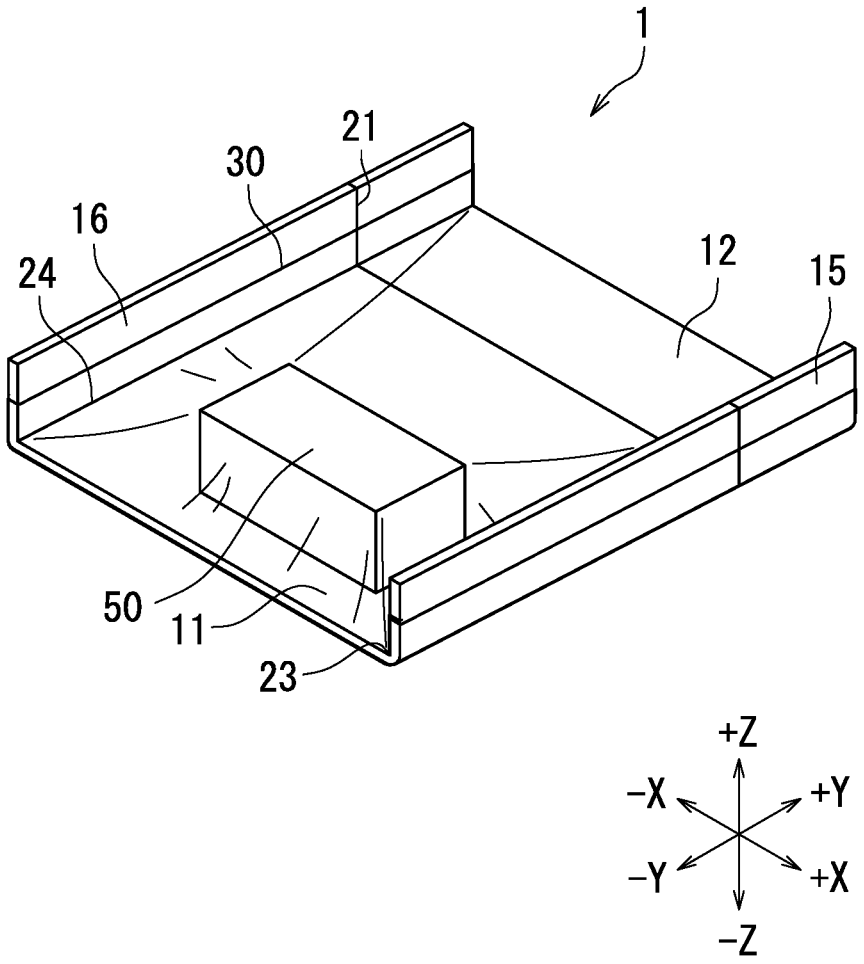
FIG. 24 is a perspective view illustrating a raised state of the raised sections.

FIG. 24 is a perspective view illustrating a raised state of the raised sections 15 and 16.

As illustrated in FIG. 24, the subsidiary fold lines 23 and 24 intersect with the main fold line 21 on the board 10. Therefore, bending the raised sections 15 and 16 along the subsidiary fold lines 23 and 24 enables the board 10 to be kept with part of the board 10—the displacement surface 11 and the adjacent surface 12 leveled (with the adjacent surface 12 leveled relative to the displacement surface 11 so that the adjacent surface 12 is substantially flush with the displacement surface 11). In other words, it is impossible to bend the raised sections 15 and 16 unless the displacement surface 11 and the adjacent surface 12 are leveled. In the present embodiment, the board 10 is provided with the two raised sections 15 and 16 along the two subsidiary fold lines 23 and 25 that do not intersect with each other on the board 10. Therefore, bending and raising the raised sections 15 and 16 ensures that a leveled state of part of the board 10 corresponding to the displacement surface 11 and the adjacent surface 12 is maintained.

Figure 25:
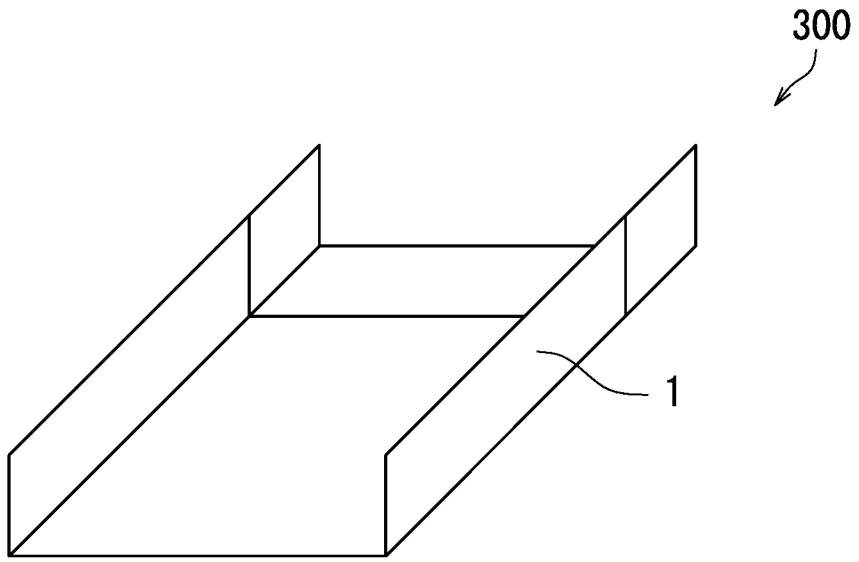
FIG. 25 is a perspective view illustrating a packaging method of a target object to be packaged using the packaging set.
Figure 25:
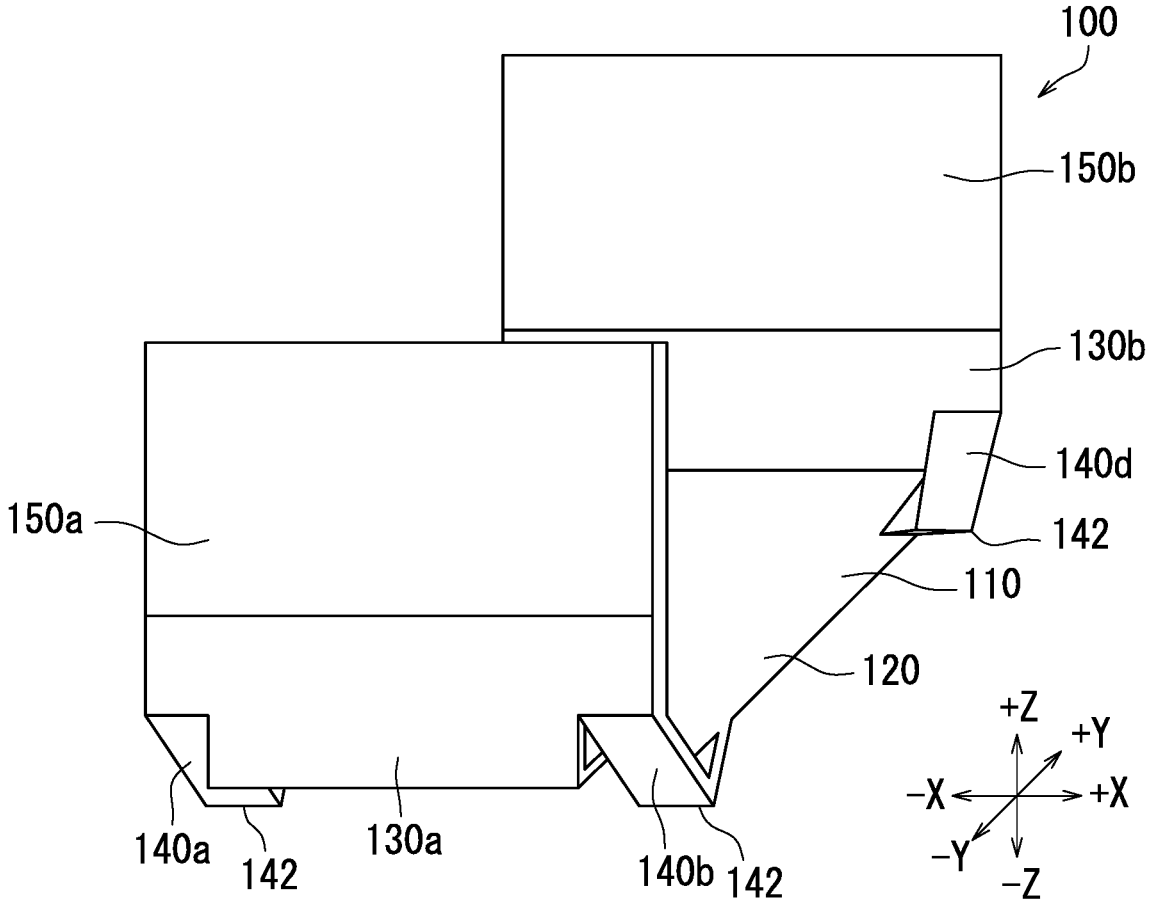
Figure 26A:
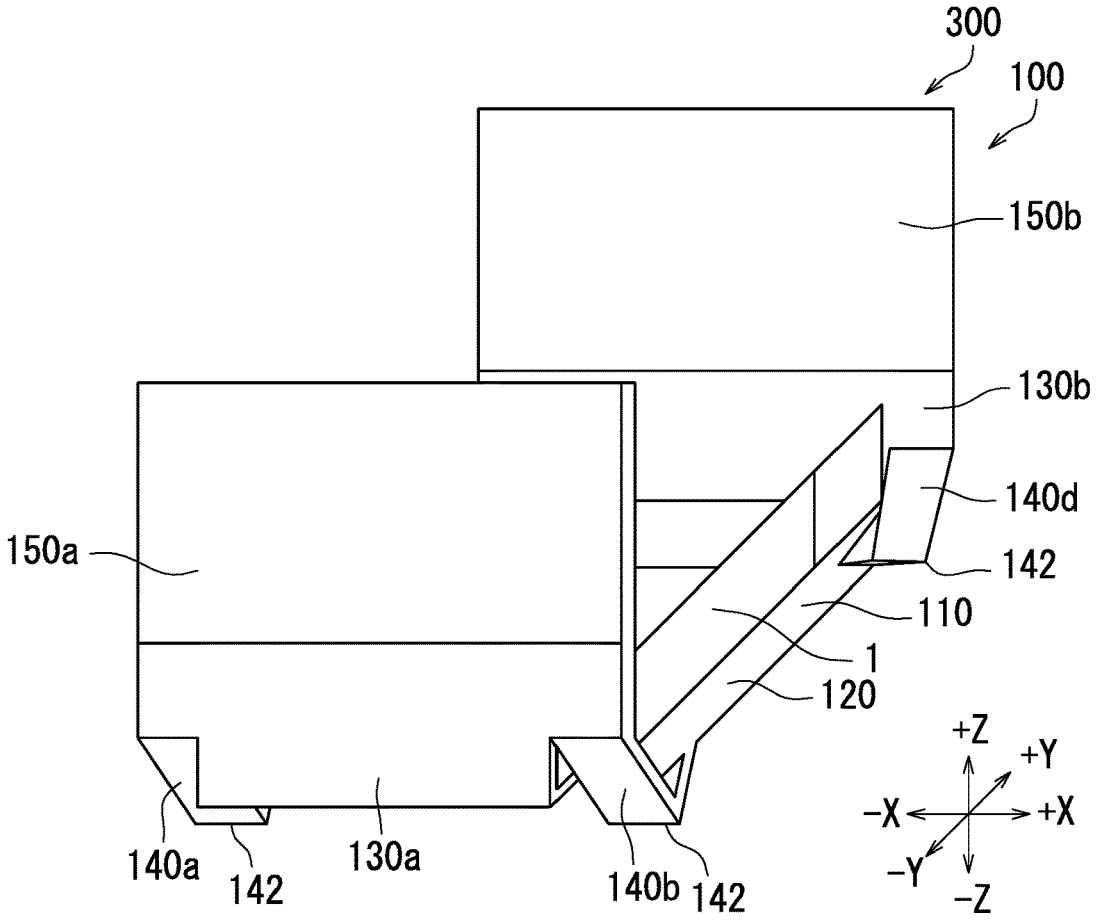
FIGS. 26A and 26B are perspective views illustrating the packaging method of the target object using the packaging set.
Figure 26B:
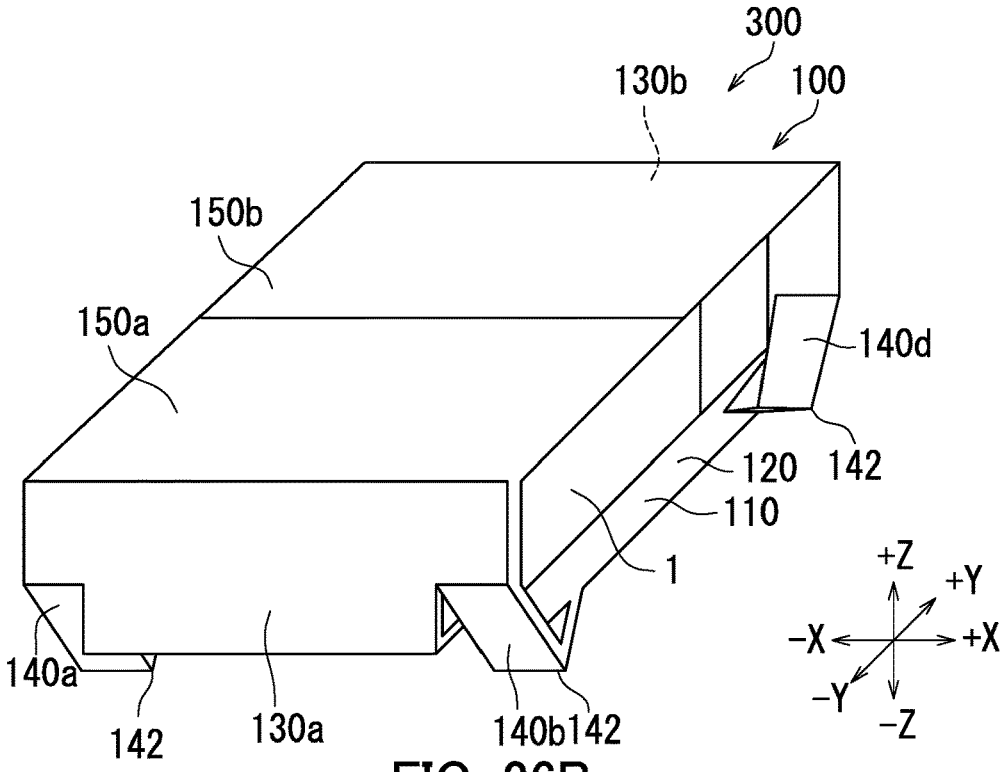

A packaging method of the target object 50 using the packaging set 300 will next be described with reference to FIGS. 25, 26A, and 26B. FIGS. 25, 26A, and 26B are perspective views illustrating the packaging method of the target object 50 using the packaging set 300. Note that in FIGS. 25, 26A, and 26B, although the film 30 of the holder 1 and the target object 50 have been omitted, the target object 50 is held by the holder 1 as illustrated in FIG. 24.

As illustrated in FIG. 25, the standing side 130*a* and the standing side 130*b* are first bent towards a Z-axis positive direction. A tongue piece 140*a* and a tongue piece 140*b* are engaged with the placement surface 120 as a result of the standing side 130*a* being bent towards the Z-axis positive direction. It is therefore possible to prevent the standing side 130*a* in a standing position from easily restoring with cardboard restoring force. It is therefore possible to keep the standing side 130*a* in the standing position at an angle of about 90 degrees relative to the placement surface 120.

Similarly, a tongue piece 140*c* and a tongue piece 140*d* are engaged with the placement surface 120 as a result of the standing side 130*b* being bent towards the Z-axis positive direction. It is therefore possible to prevent the standing side 130*b* in a standing position from easily restoring with cardboard restoring force. It is consequently possible to keep the standing side 130*b* in the standing position at an angle of about 90 degrees relative to the placement surface 120.

As illustrated in FIG. 26A, the holder 1 is then placed on the placement surface 120. The standing side 130*a* and the standing side 130*b* being kept in the standing position at the angle of about 90 degrees relative to the placement surface 120 enables easy placement of the holder 1 on the placement surface 120.

As illustrated in FIG. 26B, a top flap 150*a* is bent towards a Y-axis positive direction. A top flap 150*b* is also bent towards a Y-axis negative direction. The top flap 150*a* and the top flap 150*b* are joined with an adhesive tape. The packaging kit 100 is provided with tongue pieces 140 located at respective sides of both side edges of each standing side 130, and therefore the holder 1 is fixed by the tongue pieces 140. It is therefore possible to prevent the holder 1 from easily being shifted during transportation. Furthermore, the target object 50 is held by the holder 1. It is therefore possible to prevent the target object 50 from easily being shifted during transportation.

Note that the holder 1 has the film 30, but the present disclosure is not limited to this. For example, as long as the target object 50 is held, the holder 1 does not need to have any film 30.

Seventh Embodiment

Figure 27:
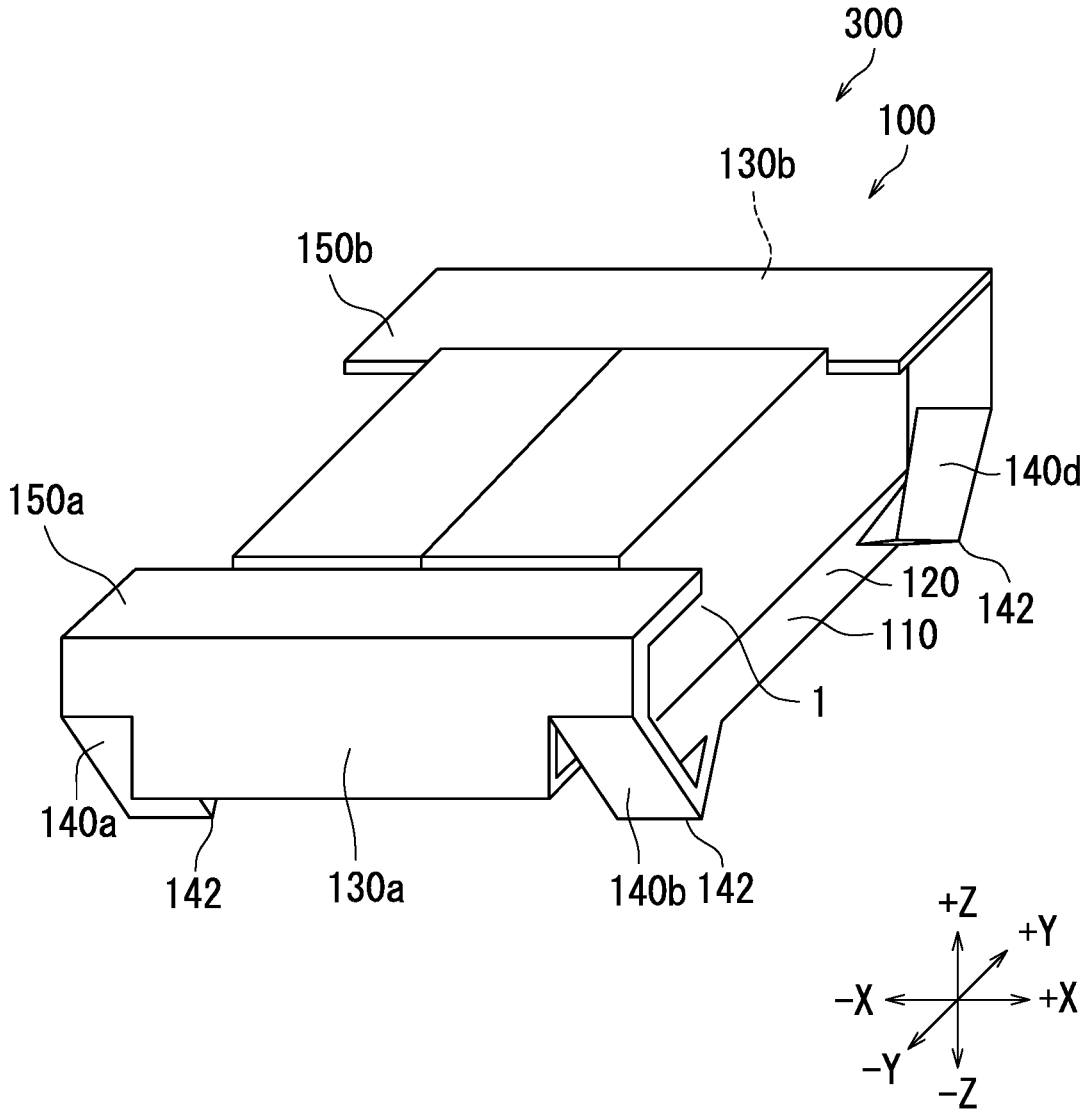
FIG. 27 is a schematic perspective view of a packaging set according to the seventh embodiment of the present disclosure.

A packaging set 300 according to a seventh embodiment of the present disclosure will be described with reference to FIG. 27. FIG. 27 is a schematic perspective view of the packaging set 300 according to the seventh embodiment of the present disclosure. In the packaging set 300 according to the sixth embodiment the packaging kit 100 has the top flaps, but in the packaging set 300 according to the seventh embodiment a packaging kit 100 and a holder 1 constitute top flaps. The description about identical constituent elements to those of the packaging set 300 according to the sixth embodiments has been omitted.

As illustrated in FIG. 27, in the packaging set 300, the top flaps are formed by the packaging kit 100 and the holder 1.

Figure 28:
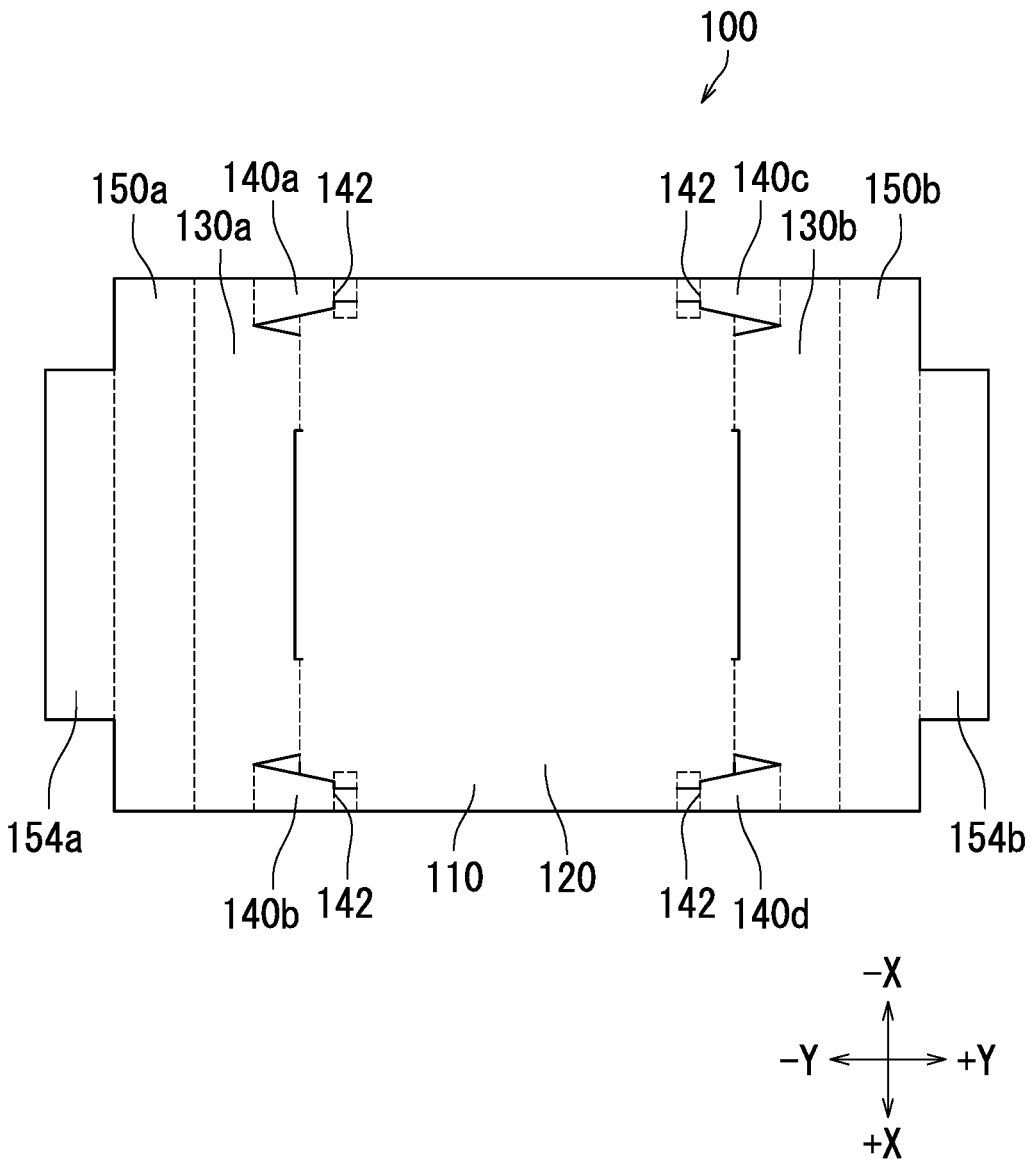
FIG. 28 is a development plan of a packaging kit according to a seventh embodiment of the present disclosure.

The packaging kit 100 according to the seventh embodiment of the present disclosure will be described with reference to FIG. 28. FIG. 28 is a development plan of the packaging kit 100 according to the seventh embodiment of the present disclosure. Except that each top flap 150 has a supporter 154, the packaging kit 100 according to the seventh embodiment has the same configuration as the packaging kit 100 according to the third embodiment, and the description of the same configuration has been omitted.

As illustrated in FIG. 28, each top flap 150 has the supporter 154. Specifically, a supporter 154*a* protrudes from a top flap 150*a*. A supporter 154*b* protrudes from a top flap 150*b*. In the present specification, the supporter 154*a* and the supporter 154*b* may collectively be referred to as supporters 154. Each supporter 154 is rectangular. Length of the supporter 154*a* along an X-axial direction is shorter than length of the top flap 150*a* along the X-axial direction. Length of the supporter 154*b* along the X-axial direction is shorter than length of the top flap 150*b* along the X-axial direction. The length of the supporter 154*a* along the X-axial direction is also shorter than a distance between a tongue piece 140*a* and a tongue piece 140*b*. The length of the supporter 154*b* along the X-axial direction is shorter than a distance between a tongue piece 140*c* and a tongue piece 140*d*. The supporters 154 support protrusions 17 and 18 of the holder 1. The protrusions 17 and 18 will be described later with reference to FIG. 29.

Figure 29:
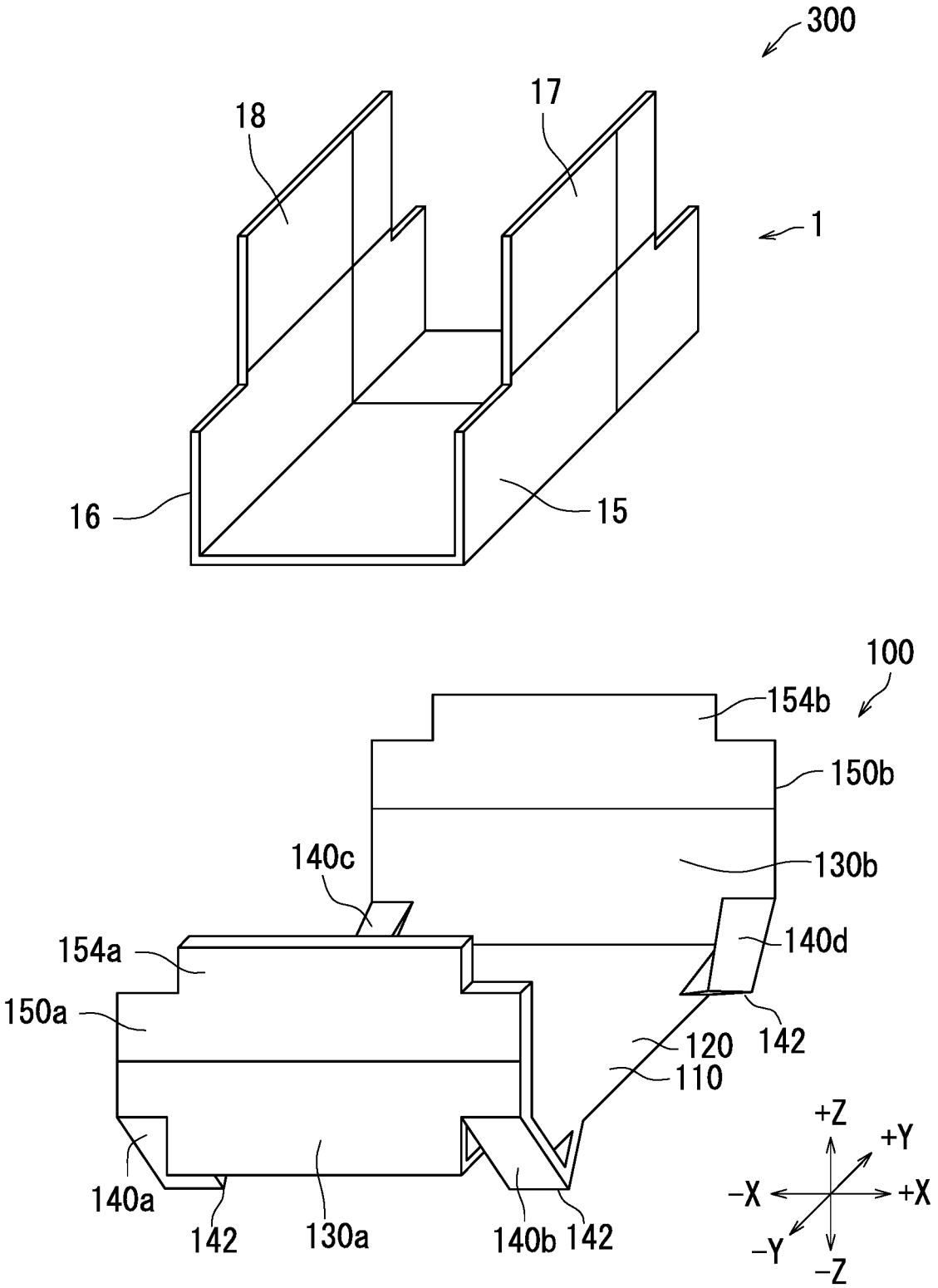
FIG. 29 is a perspective view illustrating a packaging method of a target object to be packaged using the packaging set.
Figure 30A:
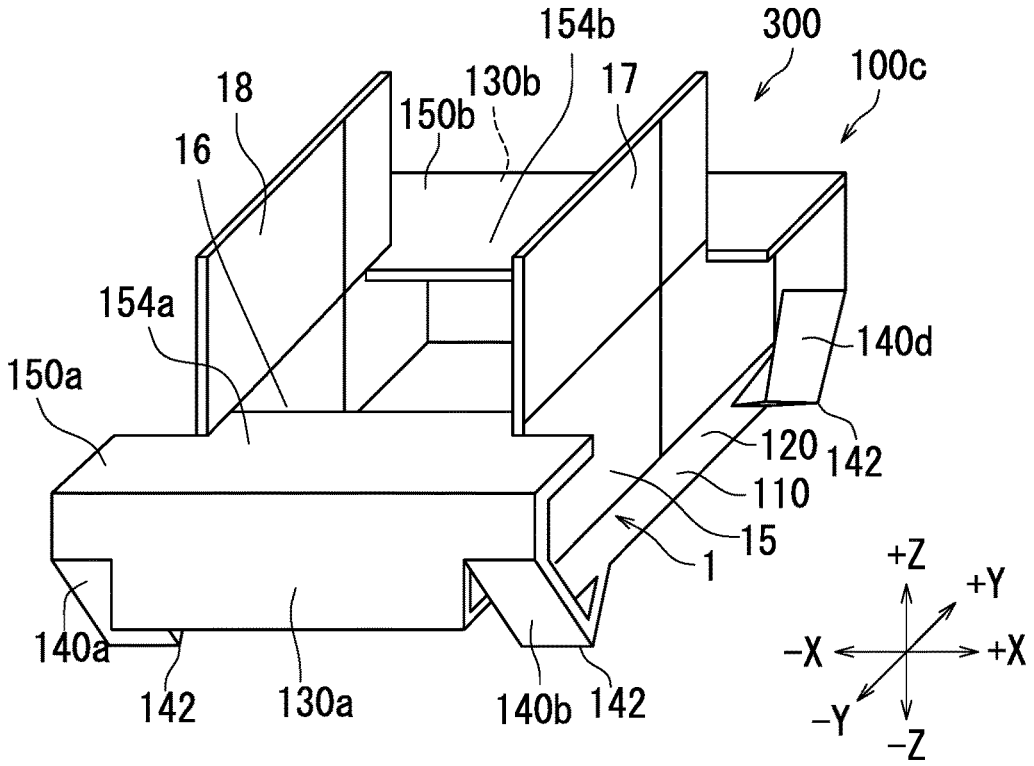
FIGS. 30A and 30B are perspective views illustrating a packaging method of a target object to be packaged using the packaging set.
Figure 30B:
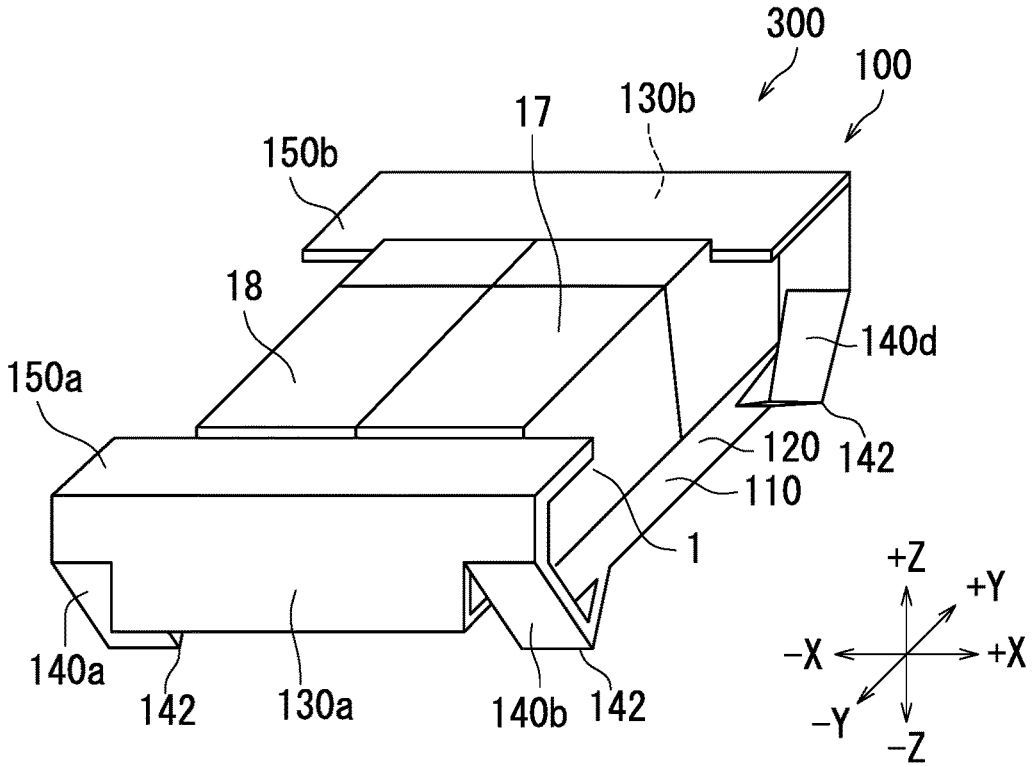

A packaging method of a target object 50 to be packaged using the packaging set 300 will next be described with reference to FIGS. 29, 30A, and 30B. FIGS. 29, 30A, and 30B are perspective views illustrating the packaging method of the target object 50 using the packaging set 300. Note that in FIGS. 29, 30A, and 30B a film 30 of the holder 1 and the target object 50 have been omitted, but the target object 50 is held by the holder 1 as illustrated in FIG. 24.

As illustrated in FIG. 29, a raised section 15 has the protrusion 17. A raised section 16 has the protrusion 18. Length of the protrusion 17 along a Y-axial direction is shorter than length of the raised section 15 along the Y-axial direction. Length of the protrusion 18 along the Y-axial direction is shorter than length of the raised section 16 along the Y-axial direction.

As illustrated in FIG. 29, a standing side 130*a* and a standing side 130*b* are first bent towards a Z-axis positive direction. The tongue piece 140*a* and the tongue piece 140*b* are engaged with a placement surface 120 as a result of the standing side 130*a* being bent towards the Z-axis positive direction. It is therefore possible to prevent the standing side 130*a* in a standing position from easily restoring with cardboard restoring force. It is therefore possible to keep the standing side 130*a* in the standing position at an angle of about 90 degrees relative to the placement surface 120.

Similarly, the tongue piece 140*c* and the tongue piece 140*d* are engaged with the placement surface 120 as a result of the standing side 130*b* being bent towards the Z-axis positive direction. It is therefore possible to prevent the standing side 130*b* in a standing position from easily restoring with cardboard restoring force. It is consequently possible to keep the standing side 130*b* in the standing position at an angle of about 90 degrees relative to the placement surface 120.

As illustrated in FIG. 30A, the holder 1 is then placed on the placement surface 120. Keeping the standing side 130*a* and the standing side 130*b* in the standing position at the angle of about 90 degrees relative to the placement surface 120 enables easy placement of the holder 1 on the placement surface 120.

The top flap 150*a* is further bent towards a Y-axis positive direction. The top flap 150*b* is also bent towards a Y-axis negative direction. The supporter 154*a* is consequently disposed inside the protrusion 17 and the protrusion 18. The supporter 154*b* is also disposed inside the protrusion 17 and the protrusion 18.

As illustrated in FIG. 30B, the protrusion 17 is bent towards an X-axis negative direction. The protrusion 18 is also bent towards an X-axis positive direction. The protrusion 17 and the protrusion 18 are supported by the supporter 154*a* and the supporter 154*b*. The protrusion 17 and the protrusion 18 are joined with an adhesive tape. The packaging kit 100 is provided with tongue pieces 140 located at respective sides of both side edges of each standing side 130, and therefore the holder 1 is fixed by the tongue pieces 140. It is therefore possible to prevent the holder 1 from easily being shifted during transportation. Furthermore, the target object 50 is held by the holder 1. It is therefore possible to prevent the target object 50 from easily being shifted during transportation.

Eighth Embodiment

Figure 31:
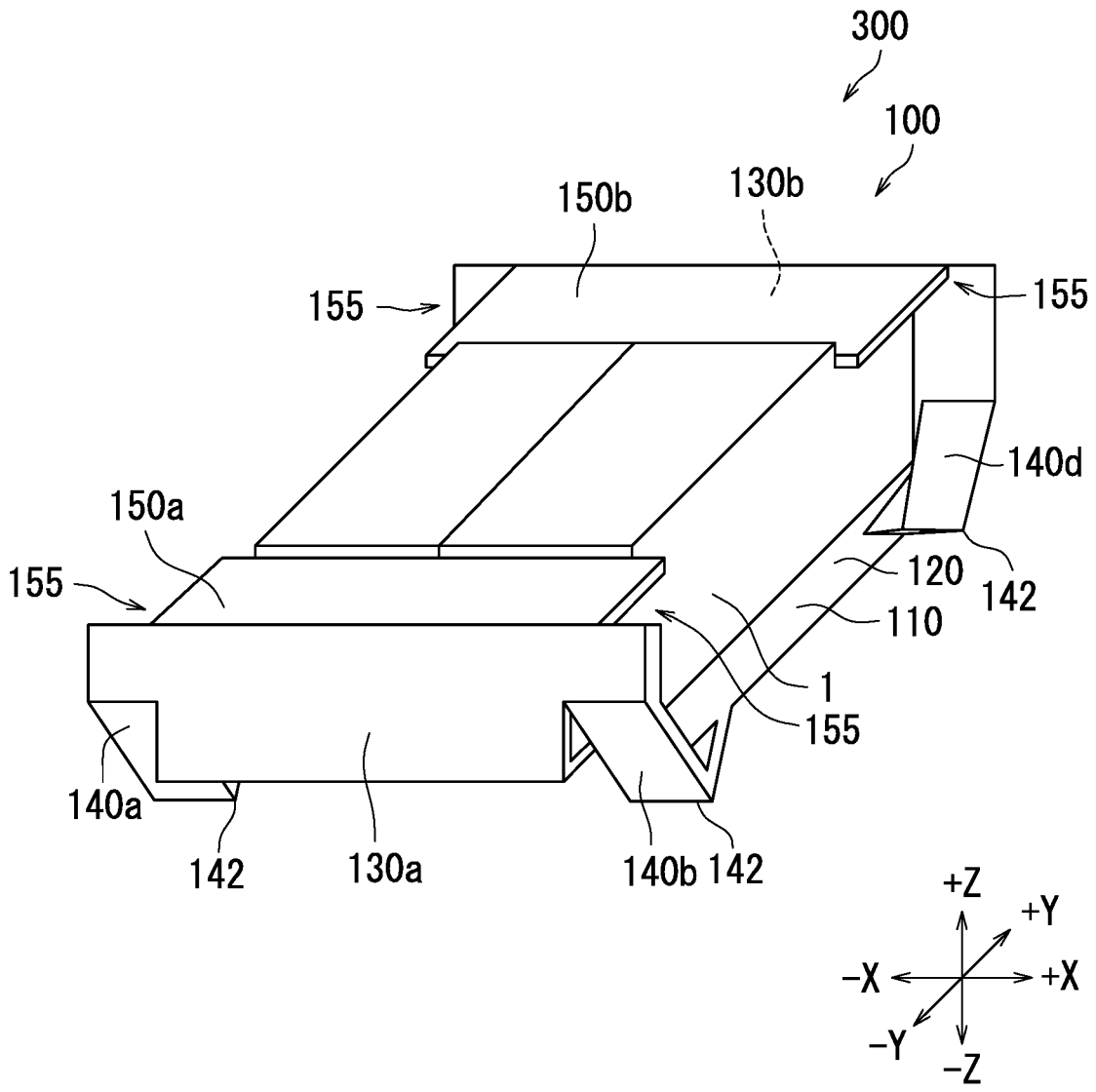
FIG. 31 is a schematic perspective view of a packaging set according to an eighth embodiment of the present disclosure.

A packaging set 300 according to an eighth embodiment of the present disclosure will be described with reference to FIG. 31. FIG. 31 is a schematic perspective view of the packaging set 300 according to the eighth embodiment of the present disclosure. Except that length of each top flap 150 along an X-axial direction is shorter than length of a corresponding standing side 130 along the X-axial direction, the packaging set 300 according to the eighth embodiment has the same configuration as the packaging set 300 according to the seventh embodiment, and the description of the same configuration has been omitted.

As illustrated in FIG. 31, the length of each top flap 150 along the X-axial direction is shorter than the length of the corresponding standing side 130 along the X-axial direction. Two recesses 155 are therefore formed, on a side of a boundary of each top flap 150 and a corresponding standing side 130, in both areas of the top flap 150 in question. The recesses 155 are located at respective positions corresponding to both protrusion edges 142 on both sides of a corresponding standing side 130. Length of a top flap 150*a* along the X-axial direction is also shorter than a distance between a tongue piece 140*a* and a tongue piece 140*b*. Length of a top flap 150*b* along the X-axial direction is shorter than a distance between a tongue piece 140*c* and a tongue piece 140*d*. Note that preferably, the length of the top flap 150*a* along the X-axial direction is slightly shorter than the distance between the tongue piece 140*a* and the tongue piece 140*b*. Preferably, the length of the top flap 150*b* along the X-axial direction is slightly shorter than the distance between the tongue piece 140*c* and the tongue piece 140*d*.

Figure 32:
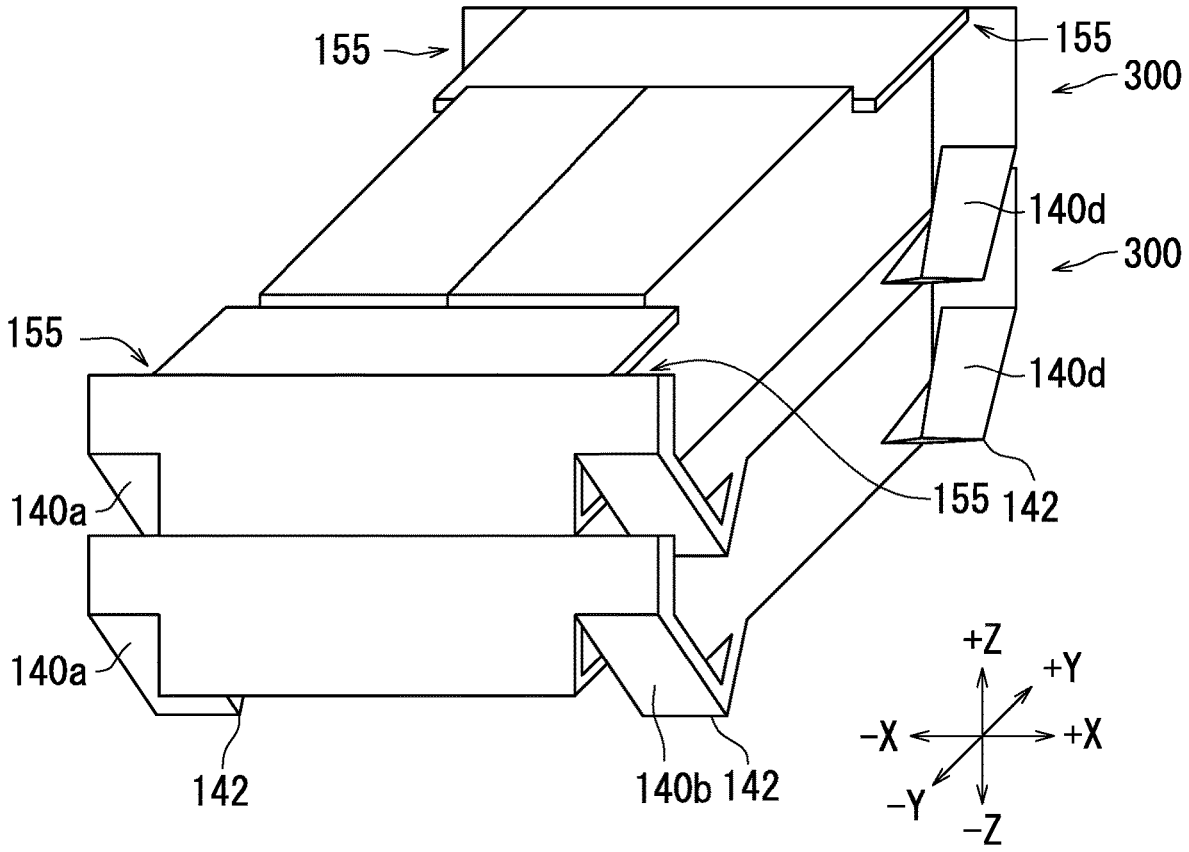
FIG. 32 is a schematic perspective view of packaging sets according to the eighth embodiment of the present disclosure.

The packaging set 300 according to the eighth embodiment of the present disclosure will further be described with reference to FIG. 32. FIG. 32 is a schematic perspective view of the packaging set 300 according to the eighth embodiment of the present disclosure. FIG. 32 depicts two-tiered packaging sets 300.

As described with reference to FIG. 31, the length of the top flap 150*a* along the X-axial direction is shorter than the distance between the tongue piece 140*a* and the tongue piece 140*b*. Two recesses 155 are also formed in both areas of a top flap 150*a* on a side of a boundary of the top flap 150*a* and a standing side 130*a*. Therefore, as illustrated in FIG. 32, placing two packaging sets 300 by causing tongue pieces 140 of one of them to correspond to recesses 140 of the other enables the packaging sets 300 to be stacked in a Z-axial direction.

Similarly, the length of the top flap 150*b* along the X-axial direction is shorter than the distance between the tongue piece 140*c* and the tongue piece 140*d*. Two recesses 155 are also formed in both areas of a top flap 150*b* on a side of a boundary of the top flap 150*b* and a standing side 130*b*. Therefore, placing two packaging sets 300 by causing tongue pieces 140 of one of them to correspond to recesses 140 of the other enables the packaging sets 300 to be stacked in the Z-axial direction.

The tongue pieces 140 of an upper packaging set 300 are inserted into the recesses 155 of a lower packaging set 300. It is therefore possible to prevent the upper packaging set 300 from easily being shifted during transportation.

Ninth Embodiment

Figure 33:
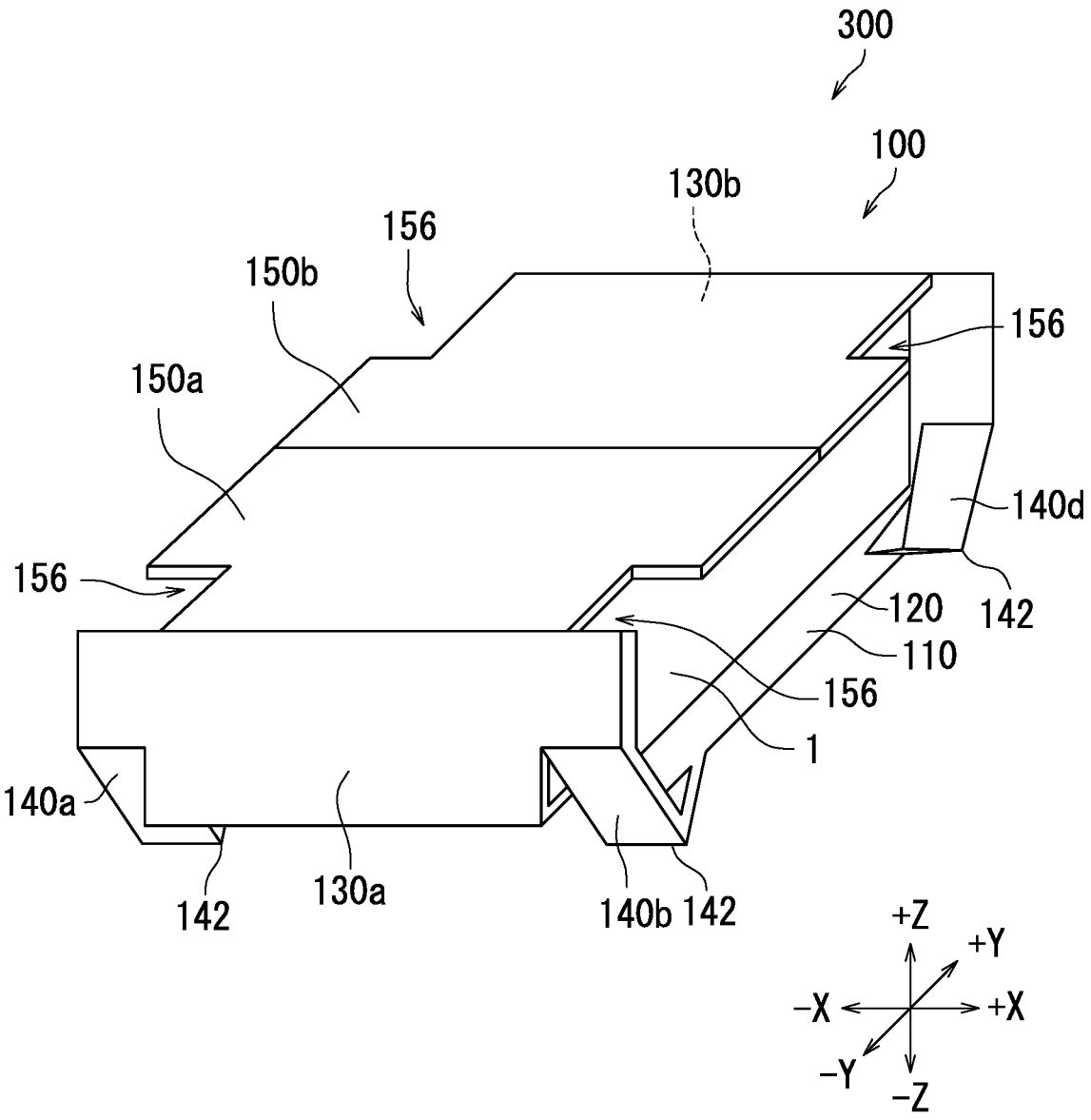
FIG. 33 is a schematic perspective view of a packaging set according to a ninth embodiment of the present disclosure.

A packaging set 300 according to a ninth embodiment of the present disclosure will be described with reference to FIG. 33. FIG. 33 is a schematic perspective view of the packaging set 300 according to the ninth embodiment of the present disclosure. Except that each top flap 150 includes a cut 156, the packaging set 300 according to the ninth embodiment has the same configuration as the packaging set 300 according to the sixth embodiment, and the description of the same configuration has been omitted.

As illustrated in FIG. 33, each of a top flap 150*a* and a top flap 150*b* has two cuts 156. The two cuts 156 are located at respective positions corresponding to two protrusion edges 142. In the top flap 150*a* provided with two cuts 156, length between the cuts 156 along an X-axial direction is shorter than a distance between a tongue piece 140*a* and a tongue piece 140*b*. Note that the length between the cuts 156 of the top flap 150*a* along the X-axial direction is slightly shorter than a distance between the tongue piece 140*a* and the tongue piece 140*b*. In the top flap 150*b* provided with two cuts 156, length between the cuts 156 of the top flap 150*b* along the X-axial direction is shorter than a distance between a tongue piece 140*c* and a tongue piece 140*d*. Note that length between the cuts 156 of the top flap 150*b* along the X-axial direction is slightly shorter than the distance between the tongue piece 140*c* and the tongue piece 140*d*.

Figure 34:
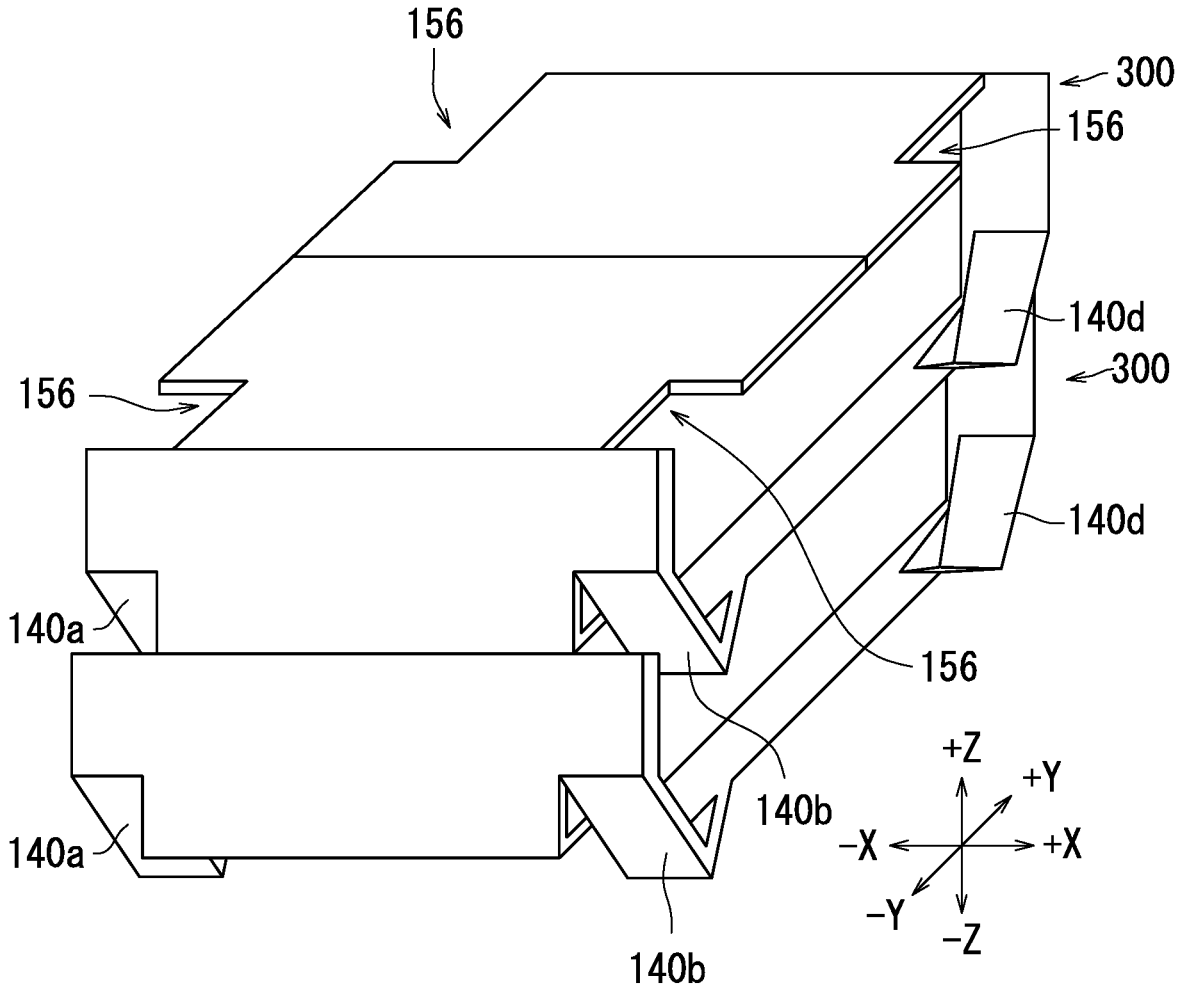
FIG. 34 is a schematic perspective view of packaging sets according to the ninth embodiment of the present disclosure.

The packaging set 300 according to the ninth embodiment of the present disclosure will further be described with reference to FIG. 34. FIG. 34 is a schematic perspective view of the packaging set 300 according to the ninth embodiment of the present disclosure. FIG. 34 depicts two-tiered packaging sets 300.

As described with reference to FIG. 33, the length between the cuts 156 of the top flap 150*a* along the X-axial direction is shorter than the distance between the tongue piece 140*a* and the tongue piece 140*b*. The top flap 150*a* also has two cut 156. Therefore, as illustrated in FIG. 34, placing two packaging sets 300 by causing tongue pieces 140 of one of them to correspond to cuts 156 of the other enables the packaging sets 300 to be stacked in a Z-axial direction.

Similarly, the length between the cuts 156 of the top flap 150*b* along the X-axial direction is shorter than the distance between the tongue piece 140*c* and the tongue piece 140*d*. The top flap 150*b* also has two cuts 156. Therefore, placing two packaging sets 300 by causing tongue pieces 140 of one of them to correspond to cuts 156 of the other enables the packaging sets 300 to be stacked in the Z-axial direction.

The tongue pieces 140 of the packaging set 300 to be stacked up are inserted into the cuts 156 of the packaging set 300 to be placed thereunder. It is therefore possible to prevent the packaging set 300 stacked up from easily being shifted during transportation.

[Variations]

Shape variation examples of tongue pieces 140 will be described with reference to FIGS. 35A to 35D. FIGS. 35A to 35D illustrate the shape variation examples of tongue pieces 140.

Figure 35A:
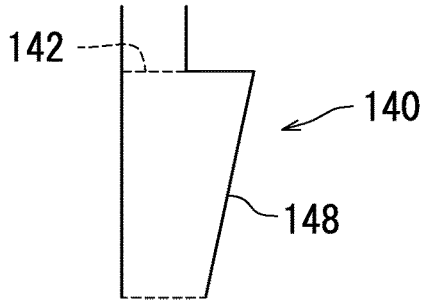
FIGS. 35A to 35D illustrate shape variation examples of the tongue piece.

In the First to ninth embodiments, the taper 148 of each tongue piece 140 is elongated with the tongue piece 140 becoming gradually narrower in width towards a corresponding protrusion edge 142, but the present disclosure is not limited to this. For examples, as illustrated in FIG. 35A, a taper 148 may be elongated with a corresponding tongue piece 140 becoming gradually wider in width towards a corresponding protrusion edge 142.

Figure 35B:
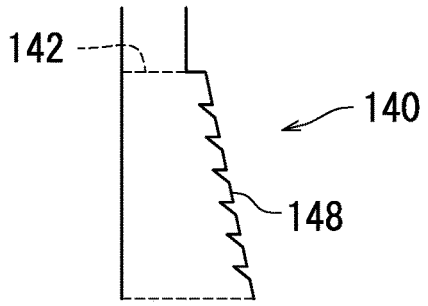

As illustrated in FIG. 35B, a taper 148 may also have an uneven shape.

Figure 35C:
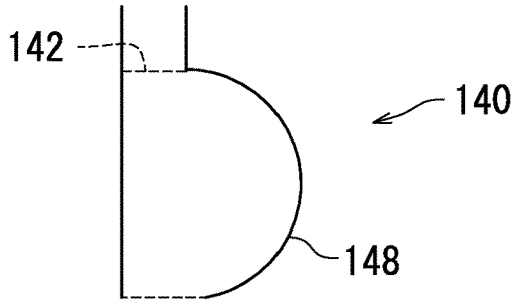

As illustrated in FIG. 35C, a taper 148 may also have a semicircular shape.

Figure 35D:
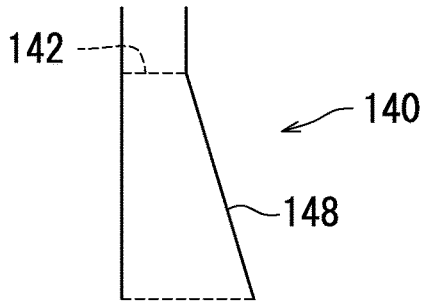

In the first to ninth embodiments, each tongue piece 140 has a rise-height section, but each tongue piece 140 does not need to have any rise-height section as illustrated in FIG. 35D.

The embodiments of the present disclosure have been described above with reference to the drawings (FIGS. 1 to 35D). Note that the present disclosure is not limited to the above-described embodiments, but is applicable to various aspects without departing from the scope of gist thereof. The drawings mainly depict schematic constituent elements for easily understanding, and therefore thickness, length, number, and the like of illustrated each constituent element are different from the actual one for the convenience of drawing. Material, shape, dimensions, and the like of each constituent element illustrated in the above-described embodiments are merely an example, and the present disclosure is not limited thereto in particular. Various variations are possible within the scope without substantially departing from the advantages of the present disclosure.

What is claimed is:

1. A packaging kit, composed of a sheet member on which a target object to be packaged is to be placed, wherein
the sheet member comprises
a placement surface that allows the target object to be placed thereon, and
a standing side that is elongated from the placement surface, the standing side being raised relative to the placement surface, wherein
the placement surface and the standing side are provided with a tongue piece that includes a protrusion edge,
the tongue piece is located on a side of at least one side edge of the standing side,
the tongue piece further includes a side edge and a side edge located inside and outside, respectively, and
the side edge located inside is in contact with a side edge of the standing side or the placement surface.

2. The packaging kit according to claim 1, wherein
the tongue piece further includes a taper, and
the taper is obliquely elongated towards the protrusion edge with the tongue piece becoming gradually narrower in width.

3. The packaging kit according to claim 1, wherein
the placement surface or the standing side is further provided with a rise-height section, and
the tongue piece is in contact with the rise-height section with the standing side raised.

4. The packaging kit according to claim 1, wherein
the tongue piece is bent in a V shape in side view so that the protrusion edge corresponds to a vertex of the V-shape in side view.

5. The packaging kit according to claim 1, wherein
the protrusion edge protrudes outside the standing side.

6. The packaging kit according to claim 1, wherein
the protrusion edge protrudes outside the placement surface.

7. The packaging kit according to claim 1, wherein
the standing side is provided with an opening in at least part of an area of the standing side adjacent to the tongue piece.

8. The packaging kit according to claim 1, wherein
the placement surface is provided with an opening in at least part of an area of the placement surface adjacent to the tongue piece.

9. The packaging kit according to claim 1, wherein
the placement surface and the standing side are further provided with a center tongue piece that includes a center protrusion edge, and
the center tongue piece is located on a center side of the standing side rather than the tongue piece.

10. The packaging kit according to claim 9, wherein
the standing side is provided with an opening in at least part of an area of the standing side adjacent to the center tongue piece.

11. The packaging kit according to claim 9, wherein
the placement surface is provided with an opening in at least part of an area of the placement surface adjacent to the center tongue piece.

12. The packaging kit according to claim 1, wherein
the sheet member further includes a top flap elongated from the standing side,
the protrusion edge protrudes below the placement surface,
a recess is formed in an area of the top flap on a side of a boundary of the top flap and the standing side, and
the recess is located at a position corresponding to the protrusion edge.

13. The packaging kit according to claim 1, wherein
the sheet member further comprises a top flap,
the protrusion edge protrudes below the placement surface,
the top flap includes a cut, and
the cut is located at a position corresponding to the protrusion edge.

14. A packaging set, comprising
the packaging kit according to claim 1, and
a holder to be placed on the placement surface with the holder holding the target object.

15. The packaging set according to claim 14, wherein
the holder includes,
a film, and
a holder sheet member to which the film is attached.

16. The packaging kit according to claim 1, wherein
the side edge located inside and the side edge located outside are movable relative to the placement surface.

* * * * *